US011103081B2

(12) United States Patent
Sherman et al.

(10) Patent No.: US 11,103,081 B2
(45) Date of Patent: Aug. 31, 2021

(54) CLIMATE CONTROLLED MATTRESS SYSTEM

(71) Applicants: Philip Reid Sherman, Melville, NY (US); Philip Woods McCarty, Natick, MA (US); Horace Robert Eskridge, III, Lexington, KY (US); Chuan-Hang Shih, Changhua County (TW)

(72) Inventors: Philip Reid Sherman, Melville, NY (US); Philip Woods McCarty, Natick, MA (US); Horace Robert Eskridge, III, Lexington, KY (US); Chuan-Hang Shih, Changhua County (TW)

(73) Assignee: PPJ, LLC, Natick, MA (US)

( * ) Notice: Subject to any disclaimer, the term of this patent is extended or adjusted under 35 U.S.C. 154(b) by 934 days.

(21) Appl. No.: 15/660,548

(22) Filed: Jul. 26, 2017

(65) Prior Publication Data

US 2018/0027981 A1 Feb. 1, 2018

Related U.S. Application Data

(60) Provisional application No. 62/367,331, filed on Jul. 27, 2016.

(51) Int. Cl.
*A47C 21/04* (2006.01)
*A47C 21/00* (2006.01)
(Continued)

(52) U.S. Cl.
CPC ..... *A47C 21/044* (2013.01); *A47C 21/048* (2013.01); *A47C 27/082* (2013.01);
(Continued)

(58) Field of Classification Search
CPC ..... A47C 21/04; A47C 21/042; A47C 21/044; A47C 21/048; A61G 7/057;
(Continued)

(56) References Cited

U.S. PATENT DOCUMENTS 1,142,876 A * 6/1915 Davis et al. ..... A47C 21/048 5/284
2,376,902 A * 5/1945 Clark ..... 219/217
(Continued)

FOREIGN PATENT DOCUMENTS

DE 19833162 A1 1/2000
WO 2012037031 A1 3/2012
WO 2017028830 A1 2/2017

OTHER PUBLICATIONS

International Search Report and Written Opinion dated Oct. 5, 2017 in related International Application No. PCT/US2017/043962 (US2016/0066701 previously cited in IDS filed on Oct. 12, 2017).

*Primary Examiner* — Robert G Santos
(74) *Attorney, Agent, or Firm* — Patent Portfolio Builders PLLC

(57) ABSTRACT

A climate control system provides the desired climate conditions of temperature and humidity at a contact surface of a multi-layered structure. The climate control system includes a heating mechanism disposed between one or more foam layers of structure and configured to deliver heat to the contact surface and a separate cooling mechanism disposed in the foam layers. The cooling mechanism includes at least one fan assembly, air channels and reticulated foam layers configured to draw air away from the contact surface toward the bottom of the structure. An operational control system is used to control the heating mechanism and cooling mechanism to achieve the desired climate conditions on the contact surface in accordance with a desired time-based climate control algorithm.

20 Claims, 23 Drawing Sheets

(51) Int. Cl.
*A47C 27/15* (2006.01)
*A47C 27/08* (2006.01)
*A47C 27/10* (2006.01)
*A47C 27/18* (2006.01)
*A47C 27/00* (2006.01)

(52) U.S. Cl.
CPC ..... *A47C 27/083* (2013.01); *A47C 27/10* (2013.01); *A47C 27/15* (2013.01); *A47C 27/18* (2013.01); *A47C 27/00* (2013.01)

(58) Field of Classification Search
CPC ..... A61G 7/05784; A61G 7/05792; A61G 2210/70; A61G 2210/90
USPC ..... 5/423, 421, 652.2, 652.1, 724–726
See application file for complete search history.

(56) References Cited

U.S. PATENT DOCUMENTS 2,606,996 A * 8/1952 Westerberg et al. ... H05B 3/342 219/217
2,715,674 A * 8/1955 Abbott et al. ..... H05B 3/342 219/212
3,101,488 A * 8/1963 Peebles ..... A47C 21/044 5/423
4,162,393 A * 7/1979 Balboni ..... A47C 21/048 219/217
4,388,738 A * 6/1983 Wagner ..... A47C 31/105 5/421
7,134,715 B1 11/2006 Fristedt et al.
7,877,827 B2 2/2011 Marquette et al.
7,914,611 B2 * 3/2011 Vrzalik ..... A61G 7/05715 96/11
7,996,936 B2 8/2011 Marquette et al.
8,065,763 B2 11/2011 Brykalski et al.
8,118,920 B2 * 2/2012 Vrzalik ..... A47C 27/14 96/11
8,181,290 B2 5/2012 Brykalski et al.
8,191,187 B2 6/2012 Brykalski et al.
8,332,975 B2 12/2012 Brykalski et al.
8,372,182 B2 * 2/2013 Vrzalik ..... A47C 27/14 96/11
8,402,579 B2 3/2013 Marquette et al.
8,418,286 B2 4/2013 Brykalski et al.
8,621,687 B2 1/2014 Brykalski et al.
8,732,874 B2 5/2014 Brykalski et al.
8,782,830 B2 7/2014 Brykalski et al.
8,881,328 B2 * 11/2014 Mikkelsen ..... A47C 21/044 5/726
8,893,329 B2 11/2014 Petrovski et al.
9,125,497 B2 9/2015 Brykalski et al.
9,138,064 B2 * 9/2015 Tursi, Jr. ..... A47C 21/044
9,392,875 B2 * 7/2016 Weyl ..... A61G 7/05776
9,596,945 B2 * 3/2017 Ghanei ..... A47C 21/044
9,603,459 B2 3/2017 Brykalski et al.
9,622,588 B2 4/2017 Brykalski et al.
9,756,952 B2 * 9/2017 Alletto, Jr. ..... A61G 7/05784
9,820,581 B2 * 11/2017 Alletto ..... A47C 21/044
10,104,982 B2 * 10/2018 Alletto ..... A47C 27/00
10,477,975 B2 * 11/2019 Tursi, Jr. ..... A47C 27/14
10,568,436 B2 * 2/2020 Alletto ..... A47C 21/048
10,898,009 B2 * 1/2021 Alletto, Jr. ..... A47C 21/042
2006/0162074 A1 * 7/2006 Bader ..... A47C 27/083 5/421
2007/0261548 A1 * 11/2007 Vrzalik ..... A47C 27/14 95/52
2009/0066122 A1 3/2009 Minuth et al.
2011/0219548 A1 * 9/2011 Vrzalik ..... A47C 27/14 5/699
2012/0017376 A1 * 1/2012 Mikkelsen ..... A47C 27/144 5/726
2012/0144584 A1 * 6/2012 Vrzalik ..... A47C 27/14 5/600
2013/0008181 A1 1/2013 Makansi et al.
2014/0026320 A1 1/2014 Marquette et al.
2014/0201909 A1 * 7/2014 Weyl ..... A61G 7/05715 5/423
2014/0201925 A1 * 7/2014 Tursi, Jr. ..... A47C 17/86 5/722
2014/0237719 A1 8/2014 Brykalski et al.
2015/0208814 A1 * 7/2015 Alletto, Jr. ..... A47C 27/00 5/423
2015/0238020 A1 8/2015 Petrovski et al.
2015/0296992 A1 * 10/2015 Ghanei ..... A47C 21/044 5/423
2015/0327686 A1 * 11/2015 Tursi ..... A47C 27/14 5/726
2016/0066701 A1 3/2016 Diller et al.
2016/0128487 A1 5/2016 Eskridge, III et al.
2016/0150891 A1 6/2016 Brykalski et al.
2017/0071359 A1 3/2017 Petrovski et al.
2017/0150823 A1 * 6/2017 Alletto ..... A47C 21/042
2017/0273470 A1 9/2017 Brykalski et al.
2017/0290437 A1 10/2017 Brykalski et al.
2018/0027981 A1 * 2/2018 Sherman ..... A47C 27/083
2018/0042393 A1 * 2/2018 Alletto ..... A47C 27/14
2018/0289172 A1 * 10/2018 Alletto ..... A47C 21/044
2020/0170417 A1 * 6/2020 Alletto ..... A61G 7/05784
2020/0326107 A1 * 10/2020 Makansi ..... A61G 7/057

* cited by examiner 850 851 853 854 855 852 856 857

| | | Male | | | | | | Female | | | | | |
|---|---|---|---|---|---|---|---|---|---|---|---|---|---|
| | | 5th % M | 5th % In | 50th % M | 50th % In | 95th % M | 95th % In | 5th % M | 5th % In | 50th % M | 50th % In | 95th % M | 95th % In |
| | Body Segment | | | | | | | | | | | | |
| Stature | A | 1.649 | 65 | 1.759 | 69 | 1.869 | 74 | 1.518 | 60 | 1.618 | 64 | 1.724 | 68 |
| Eye height (standing) | B | 1.545 | 61 | 1.644 | 65 | 1.748 | 69 | 1.427 | 56 | 1.52 | 60 | 1.63 | 64 |
| Mid shoulder height | C | 1.346 | 53 | 1.44 | 57 | 1.564 | 62 | 1.21 | 48 | 1.314 | 52 | 1.441 | 57 |
| Waist height | D | 0.993 | 39 | 1.102 | 43 | 1.188 | 46 | 0.907 | 36 | 0.985 | 39 | 1.107 | 44 |
| Buttocks height | E | 0.781 | 30 | 0.839 | 33 | 0.919 | 36 | 0.691 | 27 | 0.742 | 29 | 0.832 | 33 |
| Sitting height | F | 0.859 | 34 | 0.927 | 37 | 0.975 | 38 | 0.797 | 31 | 0.853 | 34 | 0.911 | 36 |

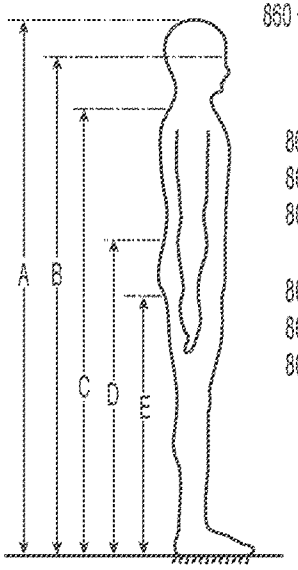

860

| | Zone Location - assumes 3" top of head - Stature (A) top of mattress: | | | | |
|---|---|---|---|---|---|
| | | Male | | Female | |
| | | 95th % M | 5th % M | 95th % M | 5th % M |
| 865 | A | 74 | 65 | 68 | 60 |
| 866 | C | 62 | 53 | 57 | 48 |
| 867 | E | 38 | 30 | 33 | 27 |
| | | | | | |
| 862 | To shoulders | 15 | 15 | 14 | 15 |
| 863 | To lower buttocks | 26 | 23 | 24 | 21 |
| 864 | Top to lower buttocks | 41 | 38 | 38 | 36 |
| | | | | | |

868 869

A: Stature
B: Eye height (standing)
C: Mid shoulder height
D: waist height
E: Buttocks height

*Fig. 11*

CLIMATE CONTROLLED MATTRESS SYSTEM

CROSS REFERENCE TO RELATED APPLICATIONS

The present application is a continuation of, and claims priority from, U.S. patent application Ser. No. 62/367,331 filed Jul. 27, 2016. The entire disclosure of that application is incorporated herein by reference.

TECHNICAL FIELD

Embodiments of the subject matter disclosed herein relate to mattresses and in particular to integrated heating and cooling systems for mattresses.

BACKGROUND

One aspect of the comfort associated with any mattress or other seating surface such as car seats is the temperature of the surface that is in contact with the user. The ambient environment can contribute to a contact surface that is unacceptably hot or cold. In addition, body heat and moisture can raise the temperature or create moisture on the contact surface that degrades comfort and leads to decreased sleep quality or user fatigue. Conventional solutions address one or the other of these conditions, i.e., heat or cold, separately or independently. For example, a hot contact surface is cooled by directing an air flow toward and through the contact surface. Therefore, air is being directed onto the user. A cold surface is heated, for example, using heating elements placed under the surface or a covering fabric layer of the contact surface. These heating elements are typically arranged in a uniform distribution that focuses on providing the desired heating uniformly across the contact surface regardless of the size of the user. Moreover, these heating elements are typically cycled on and off based on a temperature set point.

More advanced heating systems attempt to use heating technology based on the Peltier effect or thermoelectric device (TED) technology. These solutions, however, are more complicated and result in increased costs associated with heating or cooling a contact surface. Therefore, solutions are desired that provide for climate control of a contact surface of a mattress or seating surface that overcome these shortcomings of conventional systems.

SUMMARY

Exemplary embodiments are directed to climate control systems for mattresses or other cushioned support surfaces that provide adjustable heating and cooling not only on the contact surface but throughout and within the mattress. Therefore, exemplary embodiments provide a micro-climate on the support surface and within the mattress. Exemplary embodiments are also directed to mattresses having integrated heating and cooling mechanisms. The climate control system interface allows for operation as a stand-alone solution for mattress and for integration of the heating and cooling system into an adjustable base or adjustable frame of an adjustable bed.

The climate control systems balances heating and cooling systems simultaneously using lower cost conventional resistive heating elements in combination with an air flow system that draws air and any moisture from the user contact surface. The climate control system provides more than separate control of heating and cooling systems. The climate control system improves the overall comfort of the contact surface by controlling a plurality of climate conditions at the contact surface. These climate conditions affect comfort and include, but are not limited to, temperature, i.e., hot or cold, air flow and moisture. Improvement in the climate conditions is achieved without directing air toward the contact surface or user from inside the mattress or other cushioned support surface such as a couch or car seat.

In one embodiment, climate control is provided uniformly across the entire contact surface. Alternatively, climate control is provided independently in a plurality of separate zones across the contact surface. For example, a separate zone can be provided on either side of a mattress configured to support two users, e.g., full, queen or king size mattresses. Alternatively, different zones can be provided for different locations along the body of the user, e.g., head, torso, legs and feet. In one embodiment, the elements of the climate control system are arranged and located across the mattress to accommodate the greatest range of users based on anthropometric data for height for the male and female members of the population Exemplary embodiments are directed to a climate control system that includes a heating mechanism disposed within a multi-layered structure and configured to supply heat to an outer surface of the multi-layered structure and a cooling mechanism configured to pull air through the multi-layered structure and away from at least a portion of the contact surface. The cooling mechanism is separate from the heating mechanism. An operational control system is provided in communication with the heating mechanism and the cooling mechanism to operate the heating mechanism and the cooling mechanism to achieve desired climate conditions on the outer surface of the multi-layered structure. In one embodiment, the heating mechanism includes at least one heating element, and the cooling mechanism is disposed between the heating element and a bottom surface of the multi-layered structure opposite the contact surface. The cooling mechanism includes at least one channel passing through at least one layer in the multi-layered structure and a fan disposed in the channel to pull air through the channel away from the contact surface and past the bottom surface. In one embodiment, the heating element is a coil, a wire, a thread or a cable disposed between two layers in the multi-layered structure. In one embodiment, the climate conditions include temperature, moisture and humidity.

Exemplary embodiments are also directed to a climate controlled mattress having a contact surface, a bottom surface opposite the contact surface and a plurality of individual layers disposed between the contact surface and the bottom surface. A heating mechanism is disposed between the contact surface and the bottom surface and is configured to supply heat to at least a portion of the contact surface. A cooling mechanism separate from the heating mechanism is disposed between the contact surface the bottom surface. The cooling mechanism is configured to pull air through the mattress away from the contact surface and heating element and toward the bottom surface.

In one embodiment, the plurality of individual layers includes a first layer containing the contact surface and a plurality of vent holes passing completely through the first layer and a second layer in contact with the first layer opposite the contact surface. The second layer is an open cell foam. The heating mechanism is disposed between the first layer and the second layer. In one embodiment, the plurality of individual layers further includes a third layer in contact with the second layer opposite the first layer and a fourth layer in contact with the third layer opposite the second layer. The third layer and fourth layer are foam layers. The cooling mechanism includes a channel passing completely through the third layer and a fan assembly extending through the fourth layer. The fan assembly is aligned with the channel. In one embodiment, the fan assembly includes a fan box extending through the fourth layer, a mounting bezel attached to the attached to one end of the ban box, a fan attached to the mounting bezel and a fan shroud mounted on the fan.

In one embodiment, the plurality of individual layers includes a support layer in contact with the second layer opposite the top layer. The support layer is an air mesh having a thickness of up to about 0.4 inches. In one embodiment, the plurality of individual layers includes a third layer in contact with the second layer opposite the first layer. The cooling mechanism includes a channel passing completely through the third layer and a fan assembly extending partially through the channel. In one embodiment, the third layer includes an exhaust conduit in communication with the channel and running along the bottom surface. The fan assembly includes a mounting bezel in contact with the bottom surface and a fan box attached to the mounting bezel and extending into the channel. The fan box has a port in communication with the exhaust conduit. A fan is attached to fan box opposite the mounting bezel.

In one embodiment, an operational control system is provided in communication with the heating mechanism and cooling mechanism to operate the heating mechanism and the cooling mechanism to achieve desired climate conditions on the contact surface of the mattress. In one embodiment, the contact surface includes a head end, a foot end opposite the head end, a pair of opposing sides extending from the head end to the foot end and a plurality of non-overlapping zones running along the contact surface. Each zone occupies at least a portion of a length between the head end and the foot end and at least a portion of a width between the pair of opposing sides. The heating mechanism and the cooling mechanism are controllable to achieve desired climate conditions on the contact surface separately in each zone.

In one embodiment, the heating mechanism is a single heating element extending through all zones in the plurality of zones, and the single heating element has a plurality of separately controllable heating regions with at least one heating region disposed in each zone. In one embodiment, the heating mechanism includes a plurality of separate heating elements and at least one heating element is disposed in each zone. In one embodiment, the cooling mechanism includes a single channel passing completely through at least one layer in the plurality of layers. The single channel is in communication with each zone in the plurality of zones. A fan assembly is provided in communication with the single channel to pull air away from the contact surface in each zone and toward the bottom surface. In one embodiment, the cooling mechanism includes a plurality of separate channels passing completely through at least one layer in the plurality of layers with at least one channel disposed within each zone in the plurality of zones and a plurality of fan assemblies. Each fan assembly is in communication with one of the channels to pull air away from the contact surface in one of the plurality of zones and toward the bottom surface.

In one embodiment, a size and a location on the contact surface of each zone in the plurality of zones corresponds to anthropometric measurements for a desired percentage of humans. In one embodiment, the desired percentage of humans is at least 50%. In one embodiment, an operational control system is provided in communication with the heating mechanism and the cooling mechanism to operate the heating mechanism and the cooling mechanism to achieve desired climate conditions in each one of the plurality of zones of the contact surface.

BRIEF DESCRIPTION OF THE DRAWINGS

The accompanying drawings, which are incorporated in and constitute a part of the specification, illustrate one or more embodiments and, together with the description, explain these embodiments. In the drawings:

FIG. 11 is a set of charts used to determine zone location based on anthropometric data for the population of users;

DETAILED DESCRIPTION

Figure 1:
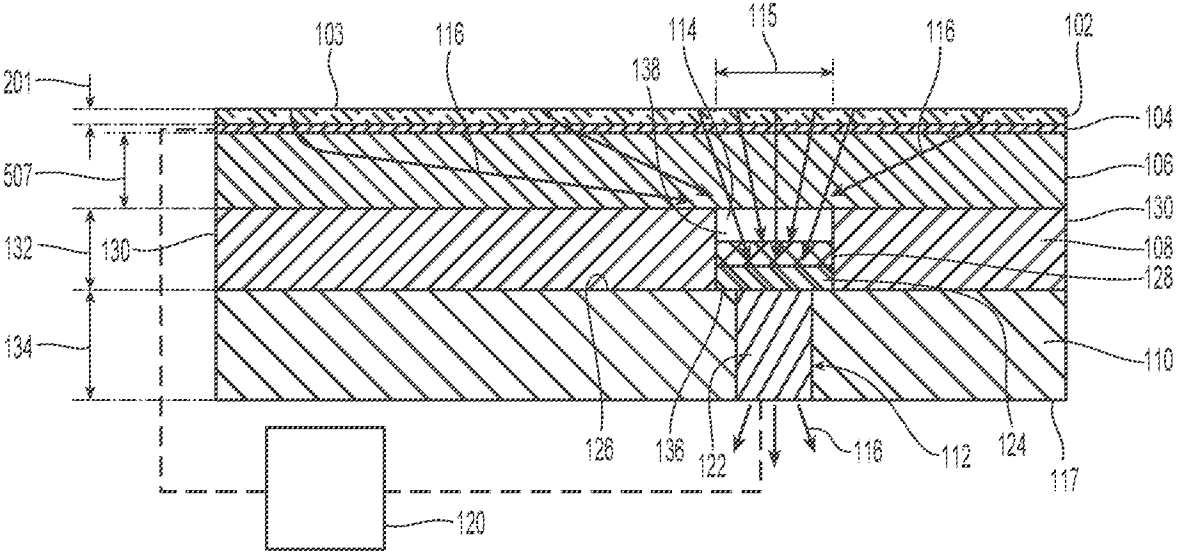
FIG. 1 is a schematic illustration of an embodiment of a climate control system in a multi-layered structure.

The following description of the embodiments refers to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Exemplary embodiments of the climate control systems provide improved climate control of contact surfaces on mattresses and other seating surfaces such as recliners and car seats. As used herein, contact surfaces refer to the outer surfaces of a mattress or seat that are intended to be in contact with the user of the mattress or seat. Suitable mattresses include any size mattress including twin, full, queen, king and California king, and the mattress can be used with conventional bedding and adjustable or articulating bedding foundations. In addition to controlling climate conditions at the contact surfaces, the climate control system controls and improves climate conditions throughout the thickness of the mattress or seating surface from the contact surface to the back surface opposite the contact surface. Suitable climate conditions include, but are not limited to, temperate, moisture and air flow. The climate control system is an improvement over other systems that utilize, for example, Peltier technology or related solutions.

The climate control system integrates at least one heating mechanism or element into a mattress. In one embodiment, the heating mechanism is integrated into the layers of a multi-layered mattress. Suitable heating mechanisms include, but are not limited to, a heating coil similar to that used in a heating blanket or heating mattress pad. In one embodiment, the heating element is located within, between or under a plurality of foam layers in the mattress. In one embodiment, the heating element is an elongated element, e.g., rope-like or tape-like, and is routed across a given layer or layer interface in the mattress using, for example, an "S" pattern. This pattern evenly distributes the heating. In one embodiment, the heating element is arranged or operated according to a plurality of zones in the mattress. In one embodiment, the heating element is a conductive thread. Suitable conductive threads include metal threads and non-metal materials such as polymers and natural fibers that are doped or coated with a conductive material such as metal. The conductive thread can be woven into a given layer or into a textile sheet to form a pad that placed among the layers.

In one embodiment, the heating element is zoned in three areas, for example, the head, the core or torso and the feet, or in any combination of these areas. Other zoning arrangements include, for example, size to side zoning and synchronized zoning.

The climate control system also includes a cooling mechanism integrated into the mattress. The cooling mechanism works in conjunction with the heating mechanism under a single common operational control system and control logic to achieve the desired overall climate conditions at one or more locations across the contact surface of the mattress. In one embodiment, the cooling mechanism includes a chemically treated top layer, i.e., layer closest to or forming the contact surface, to which a phase change material (PCM) has been applied. In one embodiment, the cooling mechanism includes one or more fan assemblies located within the layers of the mattress. In one embodiment, each fan assembly includes a shroud placed into a foam core in the mattress. The foam core includes ventilation holes for air flow.

In operation, the fan assembly does not 'blow' air or introduce air into the mattress or mattress topper directly from the ambient environment in order to cool the contact surface or the layers below the contact surface. Instead, each fan assembly is arranged to draw or remove air from the mattress and to pull air and the associated heat, humidity and moisture away from the top layers, contact surface and heating element. Each fan assembly draws the heat downward and exhausts the air into at the bottom of the mattress either in a foam layer such as an articulated foam layer or via an exhaust system designed to allow the air to permeate out to the edges of the lower layers of the mattress.

A single, common operational control system is provided in communication with both the heating mechanism and the cooling mechanism of the climate control system. The operational control system includes a logic control unit, for example, a programmable logic controller (PLC), memory, control software, control electronics, sensors, communication electronics and user control interfaces. In one embodiment, the heating mechanism and cooling mechanism can be considered part of the operational control system. The operational control system executes desired or pre-programmed climate control and operational logic to balance the heating and cooling of the mattress across one or more zones in accordance with the desired comfort levels of the user. In one embodiment, the operational control system includes at least one thermistor or inlet sensor to monitor the ambient room temperature.

In one embodiment, the operational control system includes wireless communication systems including Bluetooth, WIFI and cellular communication systems. In one embodiment, the operational control system uses these communication systems to connect with a wireless communication enabled in-home thermostat to gather temperature readings. The communication systems of the operational control system can be used to interface with any similarly enabled device including, for example, WIFI enabled heating, ventilation and air conditioning (HVAC) controls. The acquired information and settings are used to determine how to control the heating and cooling mechanisms of the climate control system. In one embodiment, a smart device, e.g., smartphone or tablet computer, based on either an iOS or Android operating platform, is used in conjunction with the operational control system to control the climate control system. In one embodiment, the smart devices incorporate macros that are unique to a given user. In one embodiment, the operational control system remotely controls and monitors the climate control system, for example, from a computer, tablet or smart phone. Therefore, the user adjusts the climate of the mattress or other contact surface remotely and in advance, so that the mattress climate is at the desired climate settings when the user is ready to go to bed.

In one embodiment, the operational control system includes a time-based temperature adjustment algorithm that correlates to the body's sleep cycle. In one embodiment, the operational control system incorporates a learning algorithm that learns the sleep patterns or habits of the user and any seasonal variations in these sleep patterns. In addition to using a separate device to control the operational control system, the climate control system can include a dedicated wired or wireless remote control.

In one embodiment, the operational control system operates as a standalone system and includes embedded algorithms for time, temperature and connectivity based on thermoregulated body algorithms. In one embodiment, these algorithms are pre-determined and preset based on algorithm development relative to sleep cycles.

Referring initially to FIG. 1, exemplary embodiments are directed to a climate control system (104, 114, 112, 120) that can be integrated into a multi-layered structure (102, 106, 108, 110). Exemplary embodiments are also directed to the multi-layered structures containing the integrated climate control system. Suitable multi-layered structures include, but are not limited to, mattresses, adjustable bed foundations, car seats, upholstered chairs and couches, hospital beds, examining tables, dentist chairs, airplane seats and office chairs. Suitable multi-layered mattresses include flat mattresses configured for use with conventional fixed bed frames and box springs and articulating mattresses configured for use with adjustable beds and adjustable bed foundations. Suitable mattress sizes include twin, full, queen, king and California king.

The climate control system provides for control and customization of climate conditions at the upper face or contact surface of the multi-layered structure. The contact surface is the surface in contact with one or more portions of the body of the person using the multi-layered structure. The climate conditions include temperature, moisture and humidity. These climate conditions are at the points of contact between the portions of the body and the contact surface and represent a microclimate at those points of contact. Control and customization of the climate conditions includes balancing heat applied to the contact surface and air flow drawn away from the contact surface. In one embodiment, the climate control system utilizes one or more of convection, conduction and radiation to achieve the desired climate conditions.

The climate control system includes a heating mechanism 104 disposed within the multi-layered structure. The heating mechanism is configured and located to supply heat to the outer surface or contact surface 103 of the multi-layered structure. As illustrated, the heating mechanism supplies heat to the outer surface from below or underneath the outer surface. Heat can be applied using one or more of conduction, convection and radiation. In one embodiment, the heating mechanism includes at least one heating element. In one embodiment, the heating mechanism includes a plurality of heating elements. Suitable heating elements include resistive heating elements that convert electricity into heat. The resistive heating elements can be arranged, for example, as a coil, a wire, a cable, a pad, a thread or a plate. Suitable heating coils are known and available in the art and include resistive type heating coils, such as those that operate on 110/120 VAC power. In one embodiment, the heating mechanism includes a single heating coil. In another embodiment, the heating mechanism includes a plurality of separate heating coils. In one embodiment, the heating coil is a long, relatively thin, wire, thread or cable running between any two layers or within a given layer in various looping or serpentine arrangements.

In one embodiment, the heating mechanism includes a single heating element that generates heat uniformly across or along the heating element. In one embodiment, the heating mechanism includes a single heating element containing a plurality of heating segments. Each heating segment is separately controlled and set at a unique temperature independent of the other heating segments. In one embodiment, the heating mechanism includes a plurality of heating elements. These heating elements are arranged in series or in parallel. In one embodiment, the heating elements in the plurality of heating elements are separately controlled and set at desired temperatures.

In one embodiment, the heating elements of the heating mechanism are disposed between two adjacent layers in the multi-layered structure. The heating elements can be located between the same two layers or between different pairs or layers and, therefore, at different depths within the multi-layered structure or at different distances from the outer surface. In one embodiment, the heating elements of the heating mechanism are disposed within a single layer of the multi-layered structure. In another embodiment, the heating elements are located in two or more distinct layers of the multi-layered structure and, therefore, at different depths within the multi-layered structure or at different distances from the outer surface.

The climate control system also includes a cooling mechanism 112 disposed within the multi-layered structure. The cooling mechanism is separate from the heating mechanism. In one embodiment, the cooling mechanism is located between the heating mechanism and a bottom surface 117 of the multi-layered structure opposite the outer surface or contact surface. The cooling mechanism is configured to pull air 116, and the associated heat and moisture, through the multi-layered structure and away from at least a portion of the contact surface. Therefore, the flow of air is not directed toward the outer surface and the occupant in contact with the outer surface, but downward away from the outer surface and the occupant in contact with the outer surface. In one embodiment, air is pulled away from the contact surface and exhausted from the sides 130 of the multi-layered structure at a point below the contact surface and preferably adjacent the bottom surface.

The cooling mechanism includes at least one channel 114 passing through at least one layer within the multi-layered structure. In one embodiment, the channel is sized and located to pull air uniformly from the entire contact surface. In one embodiment, the channel is sized and located to pull air from a specific portion of the contact surface. In one embodiment, the cooling mechanism includes a plurality of separate and distinct channels. Each channel is located or aligned under a different portion of the outer surface or contact surface. In one embodiment, each channel is paired with at least one of the plurality of heating elements in the heating mechanism. In one embodiment, each channel and an associated heating element are arranged such that the heating element is located between the channel and the contact surface. The cooling mechanism also includes a fan 128 disposed in the channel to pull air through the channel away from the contact surface and past the bottom surface. In one embodiment, the materials of the various layers are used to direct or facilitate air flow into the channel or through the layers and away from the contact surface. For example, one of more layers in the multi-layered structure are constructed from materials that either allow air flow to pass through the material or that prevent air flow through the material.

The climate control system includes an operational control system 120 in communication with the heating mechanism and the cooling mechanism, e.g., the fan, to operate the heating mechanism and the cooling mechanism to achieve desired climate conditions on the outer surface of the multi-layered structure. The climate control system includes sensors, logic control units, timers, drivers and controllers used to operate the heating mechanism and the cooling mechanism. In one embodiment, the climate control system includes a power source for the heating mechanism and the cooling mechanism.

In one embodiment, the multi-layered structure is a multi-layered mattress. Therefore, exemplary embodiments are directed to a climate controlled mattress. However, the arrangement of layers described herein can be applied to any suitable type of structure. Suitable multi-layered mattresses include flat mattresses configured for use with conventional fixed bed frame and box springs and articulating mattresses configured for use with adjustable beds and adjustable bed foundations. Suitable mattress sizes include twin, full, queen, king and California king. The mattress includes the contact surface 103 and the bottom surface 117 opposite the contact surface. Between the contact surface and the bottom surface, the multi-layered mattress includes a plurality of individual and distinct layers. In one embodiment, these layers include a first top layer 102. The top layer includes the outer face 103 or contact surface of the mattress. Suitable materials for the top layer include, but are not limited to foam. In one embodiment, the top layer includes at least one fabric covering such as a breathable fabric covering or a fire sock. In one embodiment, a phase change material (PCM) is applied to the top layer or fabric covering. Any suitable PCM known and available in the art can be used.

Figure 2:
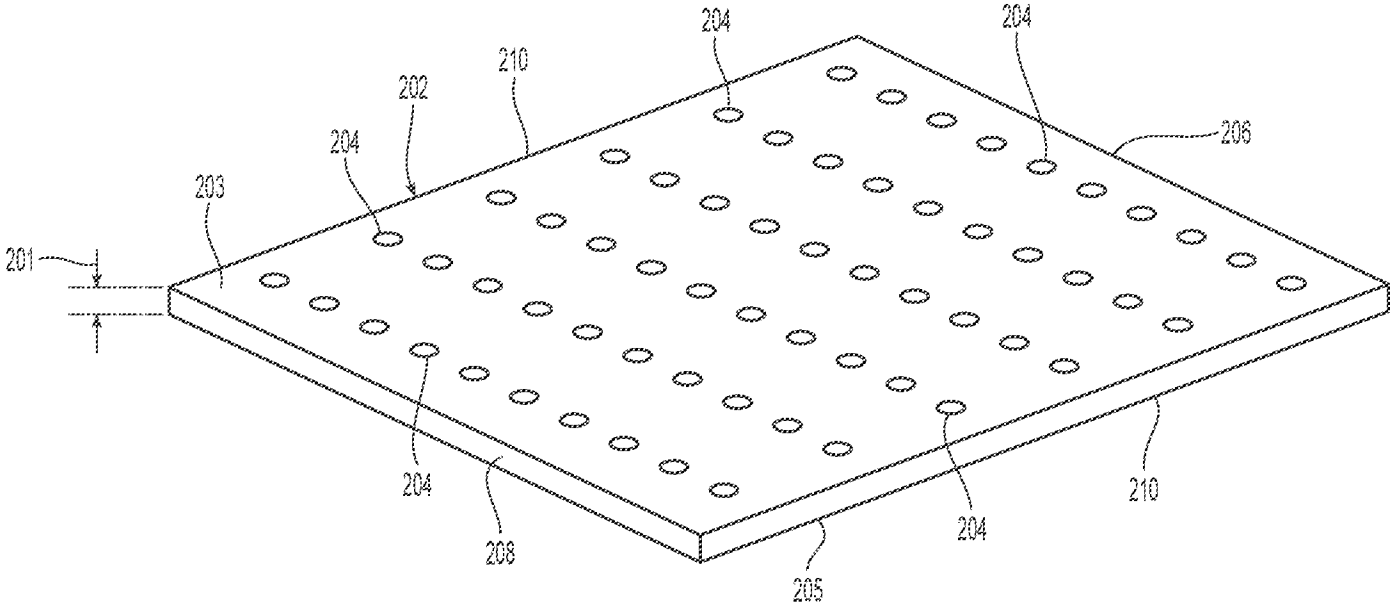
FIG. 2 is an illustration of a top perspective view of an embodiment of a first layer of the multi-layered mattress.

Referring to FIG. 2, an exemplary embodiment of a first layer 202 is illustrated. The first layer is constructed from foam. Suitable foam materials are known and available in the art and include, but are not limited to, viscoelastic foam or memory foam. The first layer includes the outer face 203 and an inner face 205 opposite the outer face. The outer face is the contact surface of the mattress. The distance between the outer face and inner face defines a thickness 201 for the first layer. Suitable first layer thicknesses include, but are not limited to, from about 1 inch up to about 2 inches. In one embodiment, the first layer is perforated or ventilated to provide for the air flow utilized by the cooling mechanism. In one embodiment, the first layer includes one or more vents or vent holes 204 passing completely through the first layer to assist with air flow, heating, cooling and moisture removal. The vent holes can have any desired cross-sectional shape including, but not limited to, circular and rectangular. In one embodiment, the vents are distributed uniformly through the first layer, for example, in a grid. In one embodiment, the grid extends across the first layer, from a first layer head end 206 to a first layer foot end 208 and between a pair of first layer opposing sides 210.

Figure 3:
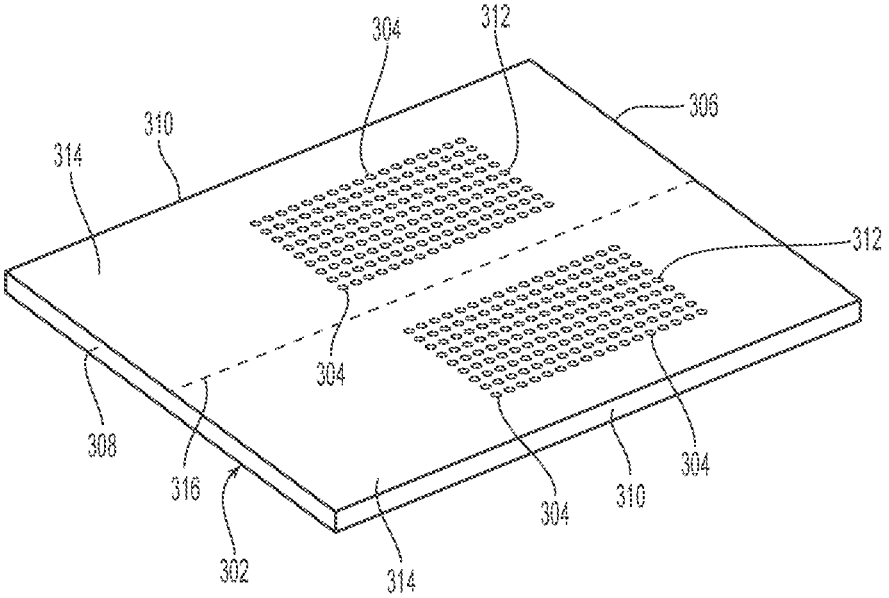
FIG. 3 is an illustration of a top perspective view of another embodiment of a first layer of the multi-layered mattress.

In addition to being uniformly distributed across the first layer, the plurality of vents can be randomly distributed across the first layer. In one embodiment, the vents in plurality of vents are arranged or grouped into a plurality of separate zones spaced across the first layer. In one embodiment, each separate zone contains an arrangement or grid of vents. In one embodiment, each separate zone corresponds to the location of at least one of the heating mechanism and the cooling mechanism within the plurality of layers. Referring now to FIG. 3, in one embodiment, the first layer 302 includes a plurality of vent holes 304 grouped in two separate zones 312. The vent holes in each zone are arranged as a grid, e.g., a rectangular grid. Each zone is located in one or two sides 314 of the mattress defined by a center line 316 passing along the length of the mattress from the first layer head end 306 to the first layer foot end 308. Therefore, the zones are suitable for mattresses that accommodate two people, for example, full, queen, king and California king mattresses. The zones do not overlap and are spaced from the first layer opposing sides 310, the first layer head end and the first layer foot end. In one embodiment, the zones are not located an equal distance from the first layer head end and the first layer foot end but are positioned on either side of the mattress closer to the first layer head end. Therefore, each zone corresponds to the torso or upper torso area of a person lying on the contact surface. In one embodiment, these separate zones correspond in size, shape and location to the heating mechanism and the cooling mechanism contained within the layers of the multi-layered mattress when the first layer is placed over other layers in the multi-layered mattress.

Figure 4:
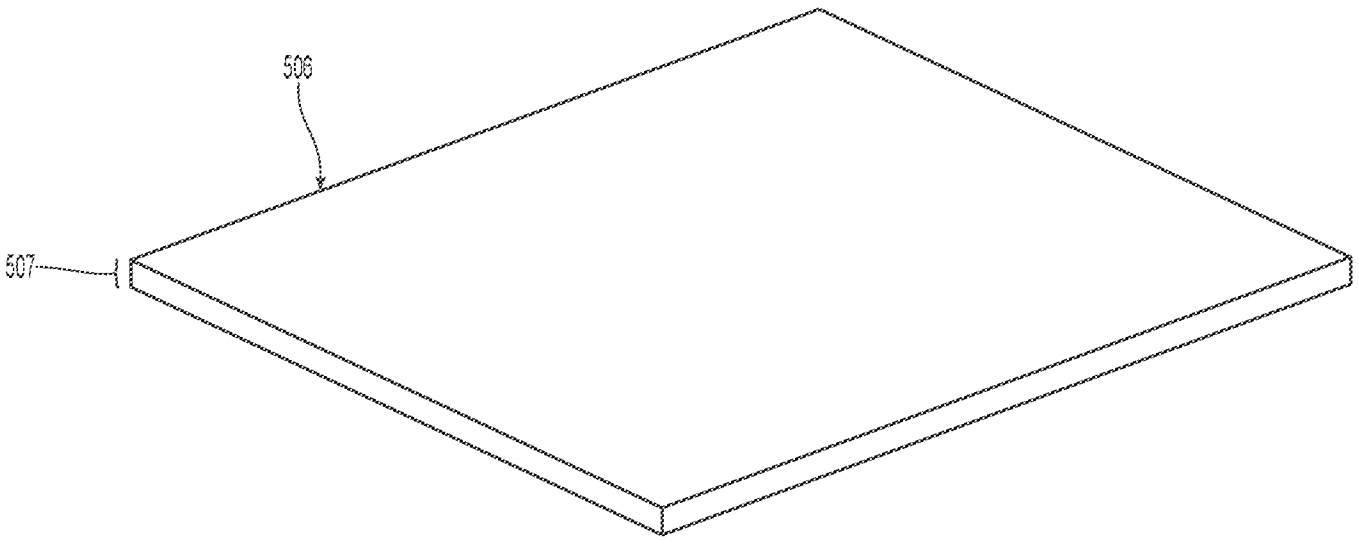
FIG. 4 is an illustration of a top perspective view of an embodiment of a second layer of the multi-layered mattress.

Returning to FIG. 1, in one embodiment, the multi-layered mattress containing the climate control system includes second layer 106 located under the first top layer. Referring to FIG. 4, in one embodiment, the second layer 506 is an open cell foam layer corresponding in size and shape to the first layer. The second layer has a second layer thickness 507. In one embodiment, the second layer thickness is greater than the first layer thickness. In one embodiment, the second layer thickness is from about 2 inches up to about 3 inches. In one embodiment, the second layer can include arrangements of vent holes. Suitable arrangements of vent holes are the same as those described above with respect to the first layer. The first and second layers can have identical arrangements of vent holes or different arrangements.

Returning to FIG. 1, the open cell foam layer facilitates air movement 116 through the multi-layered mattress from the contact surface, through the first layer, past the heating elements and through the second layer towards the bottom 117 of the mattress. In one embodiment, the second layer is a single layer of reticulated foam, for example, reticulated polyurethane foam.

As illustrated in FIG. 1, in one embodiment, the heating mechanism and the heating elements of the heating mechanism are located between the first layer and the second layer. Therefore, the heating mechanism is disposed under the first layer, and the second layer is located under the heating elements of the heating mechanism. As illustrated, the heating element is located directly underneath the first layer. However, the heating element can be located between other layers or between multiple adjacent layers in the multi-layered mattress. In another embodiment, the heating mechanism is integrated into or contained within a given layer of the multi-layered mattress.

In one embodiment, the multi-layered mattress containing the integrated climate control system includes a third layer 108, or base layer, disposed under the second layer 106. In one embodiment, at least a portion of the cooling mechanism of the climate control system is contained within or integrated into the third layer. Therefore, the third layer includes at least one channel 114 passing completely through the third layer. Alternatively, the third layer includes a plurality of separate and distinct channels at different locations within the third layer corresponding to separate zones across the contact surface of the multi-layered mattress. In one embodiment, each channel in the plurality of channel is located within zones that correspond to the zones for the vent holes in the top layer. Suitable cross-sectional shapes for each channel include, but are not limited to, circular, oblong, rectangular and square.

In one embodiment, the length-wise dimension 115 and width-wise dimension perpendicular to the length-wise dimension of each channel is constant through the entire thickness of the third layer. In one embodiment, the dimensions of the cross-section area are largest at the surface of the third layer adjacent the second layer and decrease as the channel extends away from the second layer. This creates a funnel shape and exposes a larger portion of the open cell foam of the second layer to the channel. Suitable materials for the third layer include foam. Preferably, the foam has a density and porosity sufficient to support the upper layers and components of the climate control system and to directed air flow through the channels. In one embodiment, the foam material is a large open cell foam. In one embodiment, the third layer thickness 132 is from about 7 inches up to about 10 inches.

Figure 5:
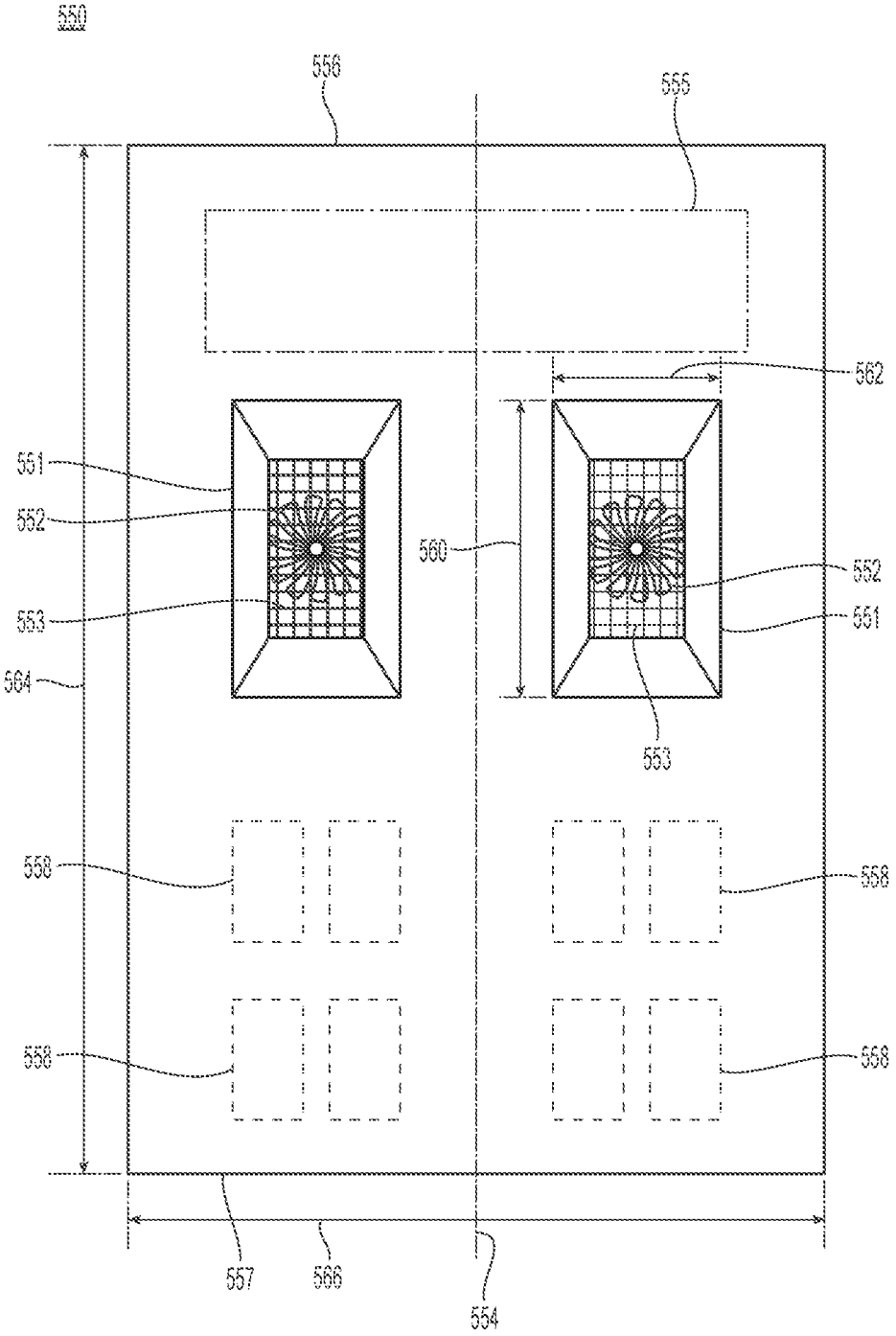
FIG. 5 is a schematic representation of a top of an embodiment of a third layer of the multi-layered mattress with channels and fan assemblies.

Referring to FIG. 5, an embodiment of the third layer 550 is illustrated. The third layer contains a pair of channels 551. Each channel is located on either side of a center line 554 extending along the length of the multi-layered mattress from the third layer head end 556 to the third layer foot end 557. Each channel is disposed closer to the third layer head end than the third layer foot end. In one embodiment, these channels are arranged to correspond to the arrangement of vent holes in at least one of the first layer and the second layer. As illustrated, the channel length 560 and the channel width 562 narrow, e.g., producing a funnel shape, as the channel extends through the third layer. At least one fan 552 is disposed in each channel. In one embodiment, a shroud 553 is located over each fan to protect the blades of the fan. Suitable shrouds include wire mesh and plastic shrouds. The third layer can include other arrangements of channels including, but not limited to, channels 555 that extend across the entire third layer and are centered on the center line. In one embodiment, arrangements of a plurality of smaller channels 558 can be used. The channels and groupings of channels can be located or centered at any point along the third layer length 564 and third layer width 566.

Returning to FIG. 1, in one embodiment, the multi-layered mattress containing the climate control system includes a fourth layer 110 or bottom layer located under the third layer. In one embodiment, the fourth layer is constructed of a foam having a density and porosity sufficient to support the upper layers and components of the climate control system.

In one embodiment, at least one fan assembly 112 passes through the fourth layer, preferably completely through the fourth layer to the bottom of the multi-layered mattress. In one embodiment, a plurality of fan assemblies passes through the fourth layer. In one embodiment, each fan assembly is disposed completely within and affixed to the fourth layer. In one embodiment, the fan assembly extends from the fourth layer and into the channel in the third layer. Each fan assembly is part of the cooling mechanism of the climate control system. Each fan assembly is arranged to direct air flow 116 away from the contact surface of the first layer, downward through first layer, heating mechanism and second layer, through the plurality of channels and fan assemblies and out the bottom face 117 of the mattress. In one embodiment, each fan assembly is aligned with one of the channels passing through the third layer. Therefore, the combination of the channels and the fan assemblies provide paths for the air flow 116 to pass from the contact surface to the bottom of the multi-layered mattress.

In one embodiment, each fan assembly includes a fan box 122 portion. In one embodiment, the fan box is disposed completely within and passes completely through the fourth layer. In one embodiment, each fan assembly includes a mounting bezel 124 attached to one end of the fan box. The mounting bezel can be attached to an end of the fan box adjacent the bottom 117 of the multi-layered mattress or opposite the bottom. The fan assembly includes a fan 128 or fan blades attached to the mounting bezel. Therefore, in one embodiment, the mounting bezel is located between the fan and the fan box. In another embodiment, the fan is disposed within the fan box.

The fourth layer has a fourth layer thickness 134. In one embodiment, the fourth layer thickness is equal to the third layer thickness. In another embodiment, the fourth layer thickness is greater than the third layer thickness. In one embodiment, the fan box portion extends through the fourth layer thickness. Suitable materials for the fan box include metals and plastics. The fan box is constructed of a material having sufficient rigidity to establish a passage through the fourth layer for the desired air flow. Suitable cross-sectional shapes for the fan box include rectangular and circular. In one embodiment, the fan box has a cross-sectional area that is smaller than the cross-sectional area of the channel. This creates a shoulder 136 in the channel around the fan box. In one embodiment, the mounting bezel 124 is larger than the fan box. For example, the mounting bezel has the same size and shape as the channel and extends into the channel, resting on the shoulder in the top surface 126 of the fourth layer. A space 138 remains in the channel above the fan and mounting bezel. In one embodiment, a foam filler, e.g., a reticulating foam, is used to fill the remainder of the thickness or length of the channel in this space.

Figure 6:
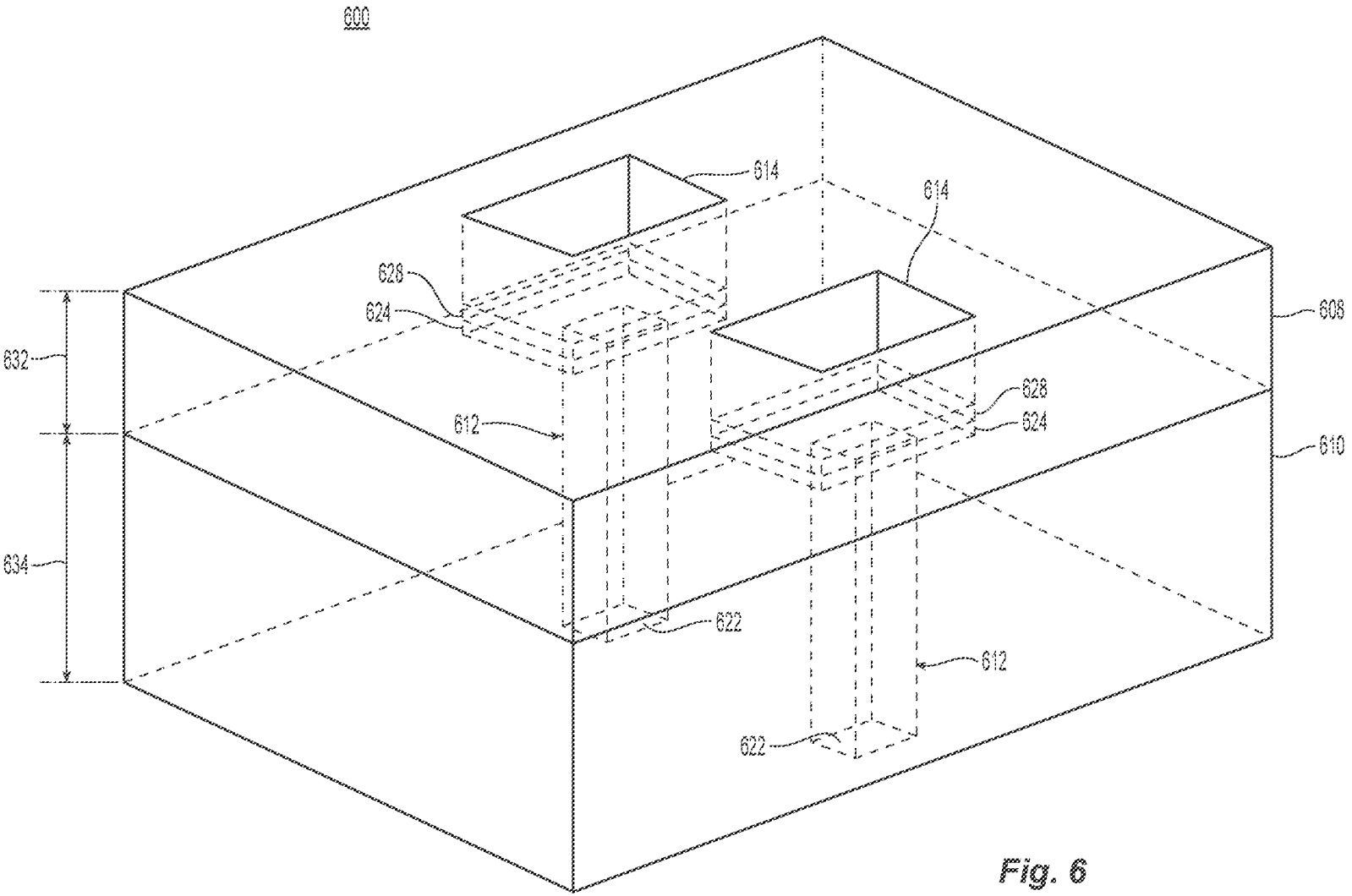
FIG. 6 is an illustration of a perspective view of an embodiment of a third layer and fourth layer of the multi-layered mattress with multiple channels and fan assemblies.

Referring now to FIG. 6, an embodiment of third layer placed over a fourth layer and containing the cooling mechanism 600 is illustrated. The third layer 608 having the third layer thickness 632 is located over the fourth layer 610 having the fourth layer thickness 634. The third layer contains a plurality of channels 614 passing completely through the third layer. As illustrated, the third layer includes two channels with each channel located on either side of the third layer. Each channel has a rectangular cross-sectional shape. The fourth layer includes a corresponding plurality of fan assemblies 612 passing through the fourth layer and aligned with the channels in the third layer.

In one embodiment, the channels are located on either side of the mattress and each extends only partially along the length of the mattress. Each fan assembly 612 includes a fan box 622 extending completely through the fourth layer thickness 634. Attached to an end of the fan box and disposed in the channel is a mounting bezel 624. A fan 628 is attached to the mounting bezel opposite the fan box. In one embodiment, a fan shroud can be placed over the fan and at least one of a filter or foam plug placed over the shroud.

Figure 7:
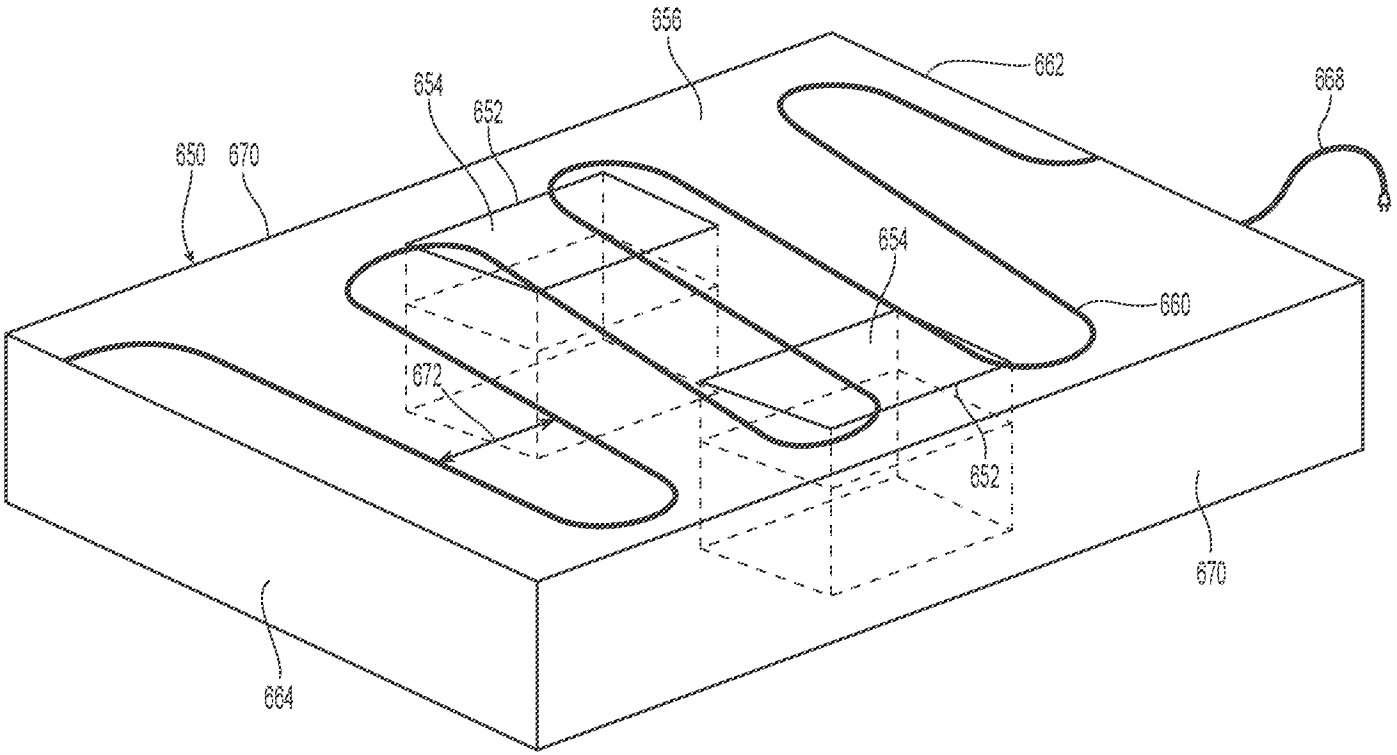
FIG. 7 is an illustration of a top perspective view of an embodiment of a third layer of the multi-layered mattress with multiple channels, channel plugs and a heating element.

Referring now to FIG. 7, an embodiment of the third layer 650 is illustrated. The third layer includes a pair of channels 652. The channels are disposed on either side of the third layer. A foam plug 654 is located in each channel to provide a flat third layer top surface 656. Each foam plug extends partially through the channel to provide space for elements of the fan assembly to be located within the channel. Suitable materials for the foam plug are the same as for the third layer. A heating element 660 is disposed on the top surface of the third layer. In one embodiment, the heating element is placed directly over the third layer and in contact with the top surface. Alternatively, one or more layers of material may be located between the heating element and the third layer top surface. While a single heating element is illustrated, a plurality of heating elements can be used and arranged either in parallel or in series. As illustrated, the heating element is a cable or wire that runs from the third layer head end 662 to the third layer foot end 664 in a serpentine pattern. The serpentine pattern wraps back and forth between the third layer opposing sides 670 along the length of the third layer.

Adjacent loops or bends in the serpentine pattern are separated by a predetermined distance 672 to achieve a desired coverage or density of heating element on the third layer top surface. In one embodiment, the predetermined distance is from about 7 inches to about 10 inches. In one embodiment, the distance can be set so that the heating coil does not pass directly over a channel. Alternately, the distance is set so that the heating coil crosses each channel one or more times, for example bisecting each channel. In one embodiment, the heating element is a resistive-type heating element running on 110-120 VAC power and includes a plug 668 that is used to supply the power to the heating element. In one embodiment, the heating element is in communication with the operational control system to control the amount of heat produced by the heating element. In one embodiment, the operation control system supplies power to the heating element.

Returning to FIG. 1, the operational control system 120 is in communication with the heating mechanism, including the heating elements, and the cooling mechanism, including the fan assembly. In one embodiment, the operational control system provides power and control to the components of the heating mechanism and the cooling mechanism. The operational control system achieves the desired climate conditions at the contact surface of the multi-layered mattress. In one embodiment, the operational control system is disposed within one or more of the layers of the multi-layered mattress. In one embodiment, the operational control system is located between one or more layers of the multi-layered mattress.

In one embodiment, the operational control system is located outside of the mattress and is in communication with the heating mechanism and the cooling mechanism through one or more wired or wireless connections. For example, the operational control system is located within the foundation, either a stationary foundation such as a box spring or an adjustable foundation, which is used to support the multi-layered mattress. In one embodiment, the operational control system is provided in conjunction with or as a modification to the systems used to provide the operations of an adjustable bed foundation. In one embodiment, the operational control system is standardized across adjustable bed foundations to facilitate the use of a multi-layered mattress containing the heating mechanism and the cooling mechanism with multiple adjustable foundations. This embodiment also facilitates the replacement or exchange a multi-layered mattresses. In one embodiment, the foundation supporting the multi-layered mattress includes vents or passages to facilitate the air flow from the multi-layered mattress.

Figure 8:
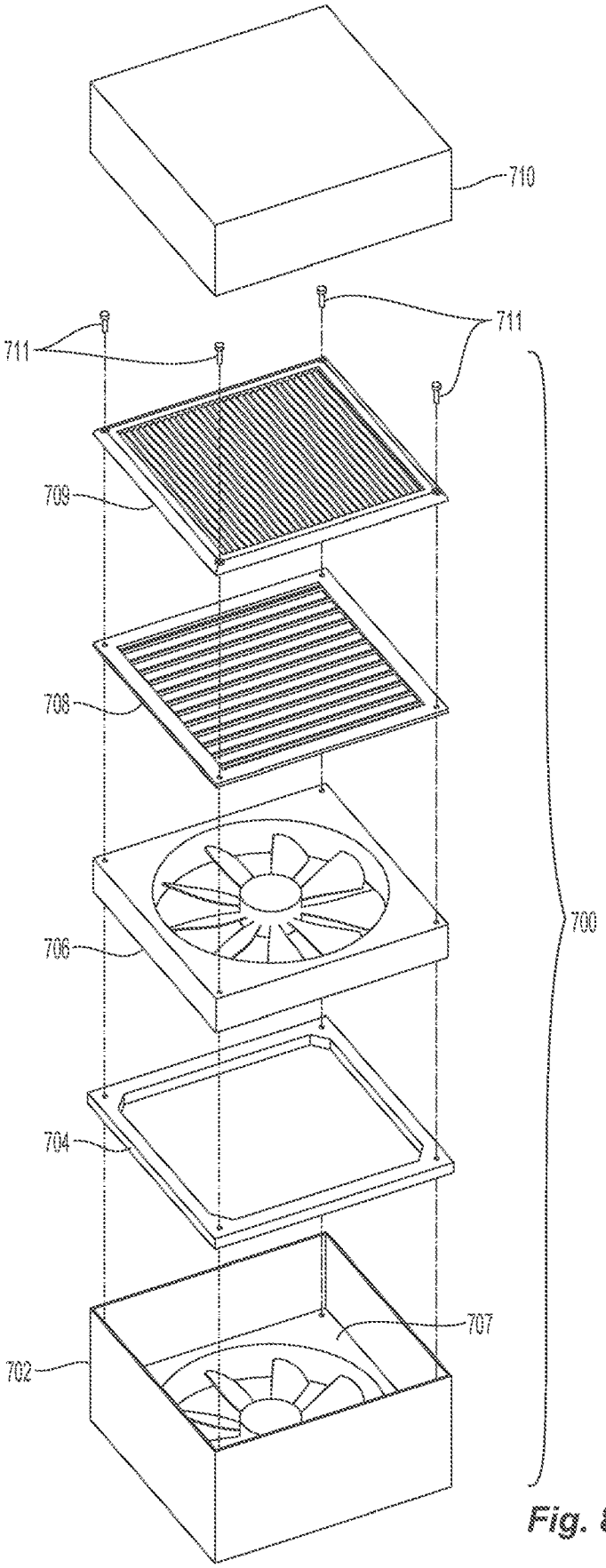
FIG. 8 is an exploded perspective view of an embodiment of a fan assembly in combination with a channel plug.

Referring to FIG. 8, an exemplary embodiment of a fan assembly 700 is illustrated. The fan assembly includes the fan box 702 having a sufficient length to extend completely through the fourth layer. As illustrated, the fan box has a rectangular cross-section and provides a passage for air flow through the fourth layer. A mounting bezel 704 is attached to one end of the fan box opposite the bottom of the multi-layered mattress. In one embodiment, the mounting bezel is formed as part of the fan box. In one embodiment, the mounting bezel is larger than the fan box and has a size and shape corresponding to the size and shape of the channel. The mounting bezel provides a mounting surface to attach the other components of the ban assembly to the fan box.

In one embodiment, the fan assembly includes a fan 706 placed over the mounting bezel such that the mounting bezel is located between the fan and the fan box. Suitable fans include DC powered electric fans and cooling fans. The fan is in communication with and controlled by the operational control system. In one embodiment, a secondary fan 707 is provided in the fan box adjacent the bottom of the multi-layered mattress. The secondary fan is also in communication with and controlled by the operational control system. In one embodiment, the only fan in the fan assembly is the secondary fan.

In one embodiment, the fan assembly includes a fan shroud 708 located over the fan. The fan shroud protects the fan and prevents debris from falling into the fan. Suitable materials for the fan shroud include metal and plastic. In one embodiment, the fan shroud is a mesh structure. In one embodiment, the fan shroud is a grate structure. In one embodiment, the fan assembly includes a filter 709. The filter captures dust and small particles contained in the air flow of the mattress. In one embodiment, the filter includes carbon or other materials to remove odors from the air flow. In one embodiment, the filter includes a desiccant to remove moisture from the air flow.

The fan assembly includes a plurality of fasteners 711 passing through one or more of the filter, fan shroud, fan and mounting bezel to secure these components to the mounting bezel and, therefore, the fan assembly. Suitable fasteners include, but are not limited to, screws and bolts. The fan assembly is illustrated in conjunction with the foam plug 710 that is used to fill the remaining length of the channel that does not contain the filter, fan shroud, fan and mounting bezel. In one embodiment, the foam plug includes vent holes.

Exemplary embodiments achieve desired climate conditions over the entire contact surface of the multi-layered mattress by dividing the contact surface into a plurality of distinct zones, distributing the heating mechanism and the cooling mechanism through the plurality of zones and operating the heating mechanism and cooling mechanism to achieve the desired climate conditions within any zone in the contact surface. Each heating zone extends along at least a portion of the length of multi-layered mattress from the head end to the foot end and along at least a portion of the width of the multi-layered mattress between the opposing sides. In one embodiment, each zone in the plurality of zones is a distinct and separate zone. In one embodiment, at least two zones in the plurality of zone overlap.

Figure 9:
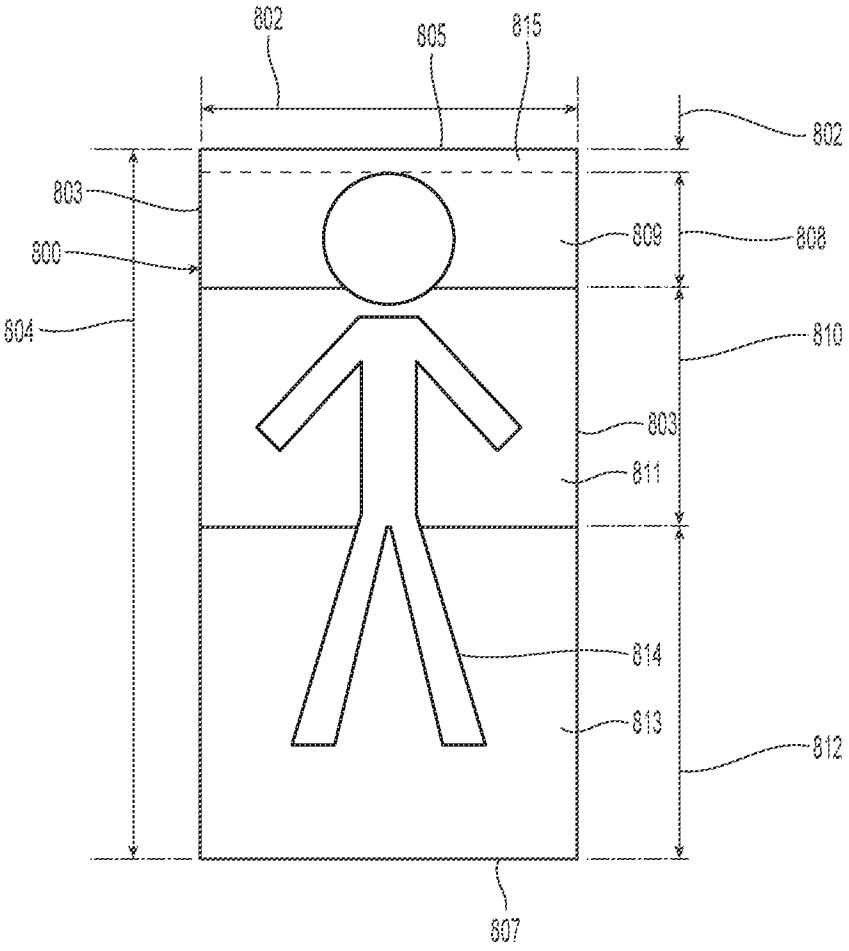
FIG. 9 is a schematic illustration of an embodiment of zone definition for climate control of a contact surface of a mattress.

Referring to FIG. 9, an embodiment of the multi-layered mattress 800 is configured to have a plurality of zones, i.e., climate control zones. As illustrated, the mattress includes three zones. The multi-layered mattress includes a width 802 between opposing sides 803 and a length 804 from a head end 805 to a foot end 807. In one embodiment, the width is about 38 inches and the length is about 80 inches. Each zone extends along at least a portion of the length and a portion of the width of the multi-layered mattress and encloses an area of the contact surface of the multi-layered mattress. Each zone corresponds to a location of a different part of the user 814 of the multi-layered mattress. For two-person mattresses, these zones are further divided into pairs of zones running along either side of the multi-layered mattress. In one embodiment, the arrangement and control of the heating mechanism and the cooling mechanism is specific to each zone.

As illustrated, the multi-layered mattress is divided into three zones and each zone extends an entire width of the multi-layered mattress. These zones include a first zone or head zone 809 extending along the length of the multi-layered mattress a first length 808. In one embodiment, the first length is about 12 inches and corresponds to the location of the head of the occupant of the multi-layered mattress. In one embodiment, the first zone is spaced from the head end by a border zone 815 extending a border zone length 802. In one embodiment, the border zone length is about 3 inches. In one embodiment, heating and cooling are not provided or are not separately controlled in the border zone.

A second zone 811 extends along the length of the multi-layered mattress a second zone length 810 from the first zone. In one embodiment, the second length is about 26 inches. The second zone corresponds to the core or torso of the occupant of the multi-layered mattress from the shoulders to hips or lower buttocks area. The multi-layered mattress includes a third zone 813 the corresponds to the area of the legs and feet of the occupant of the multi-layered mattress. The third zone extends from the second zone a third length 812 corresponding to the balance of the length of the mattress. For a multi-layered mattress having an overall length of about 80 inches, this third length is about 39 includes.

Figure 10:
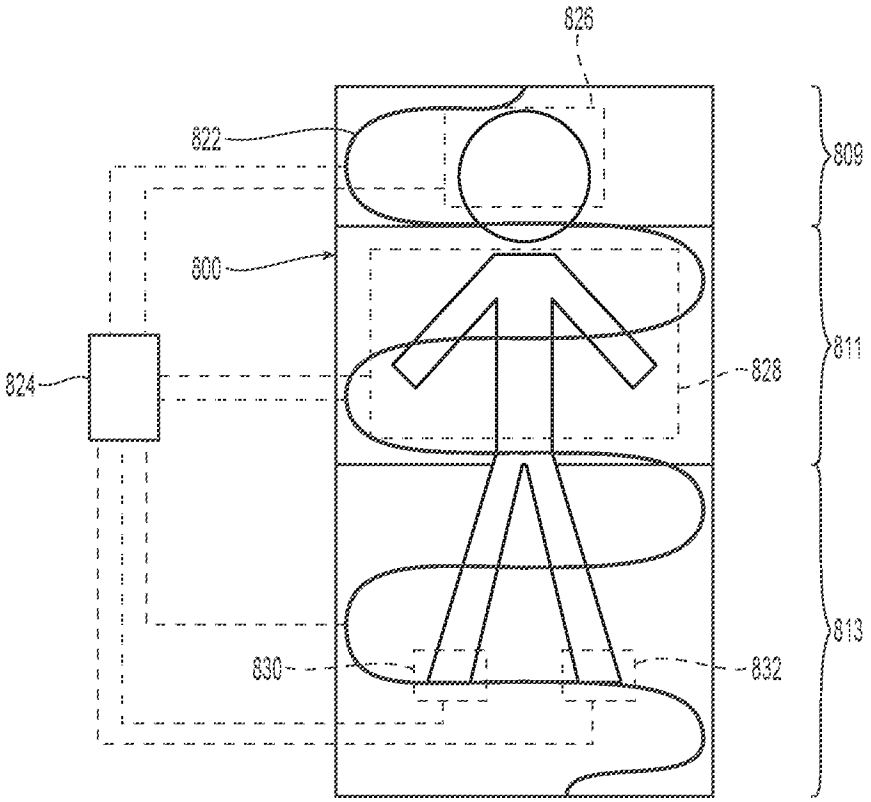
FIG. 10 is a schematic illustration of zone definition in combination with the location of heating elements and channels.

Referring to FIG. 10, the multi-layered mattress 800 is illustrated divided into the plurality of zones with the heating mechanism and cooling mechanism incorporated into the multi-layered mattress in accordance with the plurality of zones. The heating and cooling mechanisms are operated in concert according to their zones to achieve the desired overall climate control in the various zones on the contact surface of the multi-layered mattress. A heating element 822 configured as a heating wire, cable, thread or tape is also placed along the length of the mattress, preferably in the serpentine pattern as described herein. The heating element runs through the first zone 809, the second zone 811 and the third zone 813. In one embodiment, an equal length of heating element is located in each zone. In another embodiment, the length of heating element in each zone varies depending on the amount or density of heating desired in a given zone.

In general, the heating mechanism, and in particular the heating element, is operated based on zone as the requirements or desire for heating differ in each zone. For example, heating may be concentrated in the second zone 811 corresponding to the core or may be increased or elevated in at least one of the first zone and the third zone corresponding to the head and feet and legs. As illustrated, the operational control system 824 operates the heating mechanism in accordance with three zones, the first zone 809, the second zone 811 and the third zone 813

The cooling mechanism can be located in one of more zones or across one or more zones. In one embodiment, the cooling mechanism is located in only a single zone. Location of the cooling mechanism includes location of at least one of the channel and fan assembly. In addition, vent holes can be provided in the first layer corresponding to the location of the cooling mechanism. The second zone 811 corresponds to torso or body core and has largest body area in contact with the contact surface of the multi-layered mattress, extending from the shoulders to the lower buttocks. In one embodiment, the cooling mechanism includes at least one channel and fan assembly 828 located in the second zone. In one embodiment, the cooling mechanism is located only in the second zone. In one embodiment, a plurality of channels and fan assemblies are placed or concentrated in the second zone to provide maximum cooling and climate control performance.

The size, number and location of the channels and fan assemblies in any given zone can be varied. In one embodiment, a first zone channel and fan assembly 826 is located in the general area of the head of the occupant. In one embodiment, a pair of separate third zone channels and fan assemblies 830, 832 are provided in the third zone. Each third zone channel and fan assembly is located in the area of the foot of the occupant. In one embodiment, arrangements channels and fan assemblies are provides in each zone, for example, a grid of channels and fan assemblies such as 2×2 or larger grid of channels. In one embodiment, each channel and fan assembly in the grid of channels and fan assemblies is the same size.

The size and location of the zones in the plurality of zones varies depending on the size of the multi-layered mattress and the size of the occupant of the multi-layered. In one embodiment, the location and size of the zones, and therefore, the size and location of the heating mechanism and cooling mechanism in each zone is selected to provide a climate controlled multi-layered mattress that accommodates the largest variation in the size of occupants.

Referring to FIG. 11, in one embodiment, the size and location of the zones in the plurality of zones, the components of the heating mechanism and the components of the cooling mechanism utilize an anthropometric chart 850 that provides the anthropometric measurement for both male and female humans. These anthropometric measurements provide the length, dimensions or locations for a plurality of body measurements 853 as measure from the feet. These measurements are provided for both male 854 and female 855 members of the population and are expressed in both meters 856 or inches 857 that cover a given percentage of the population, i.e., 5%, 50% and 95%. For example, a stature of up to 69 inches covers 50% of the male population 851, and a mid-shoulder height of up to 57 inches covers 95% of the female population 852.

These data are used in determining the location and length of each zone as measured, for example, from the head end of the multi-layered mattress. In one embodiment, the data are also used to determine the location and arrangement of the heating mechanism and cooling mechanism within each zone. Therefore, a zone location chart 860 is generated to summarizes the ranges of body measurements that accommodate from 5% and 95% of the male population 869 and female population 868. As illustrated, the measurements are charted for the stature or height 865, the mid-shoulder height 866 and the buttocks height 867. These measurements are subtracted from each other and added to a 3 inch border zone to determine the location of the dividing lines between the first, second and third zones to cover either 5% or 95% of the male and female population.

Subtracting the mid-shoulder height from the stature and adding 3 inches yields a first zone length 862. Subtracting the buttocks height from the mid shoulder height yields the second zone length 863. Adding the first zone length to the second zone length provides the location of the beginning of the third zone 864, i.e., the spacing of the third zone from the head end. These measurements in association with the percentage of the male and female population accommodated by these zone measurements are used to determine the size and location of the zones along the contact surface that accommodated the desired percentage of both male and female humans. Suitable percentages include, but are not limited to at least 50%, at least 75% and at least 95%. These measurements can also be used to determine the location of cooling mechanisms along the length of the mattress, the location of separately controlled heating zones and the size and span of the channels and heating zones to cover a desired percentage of the population.

Figure 12:
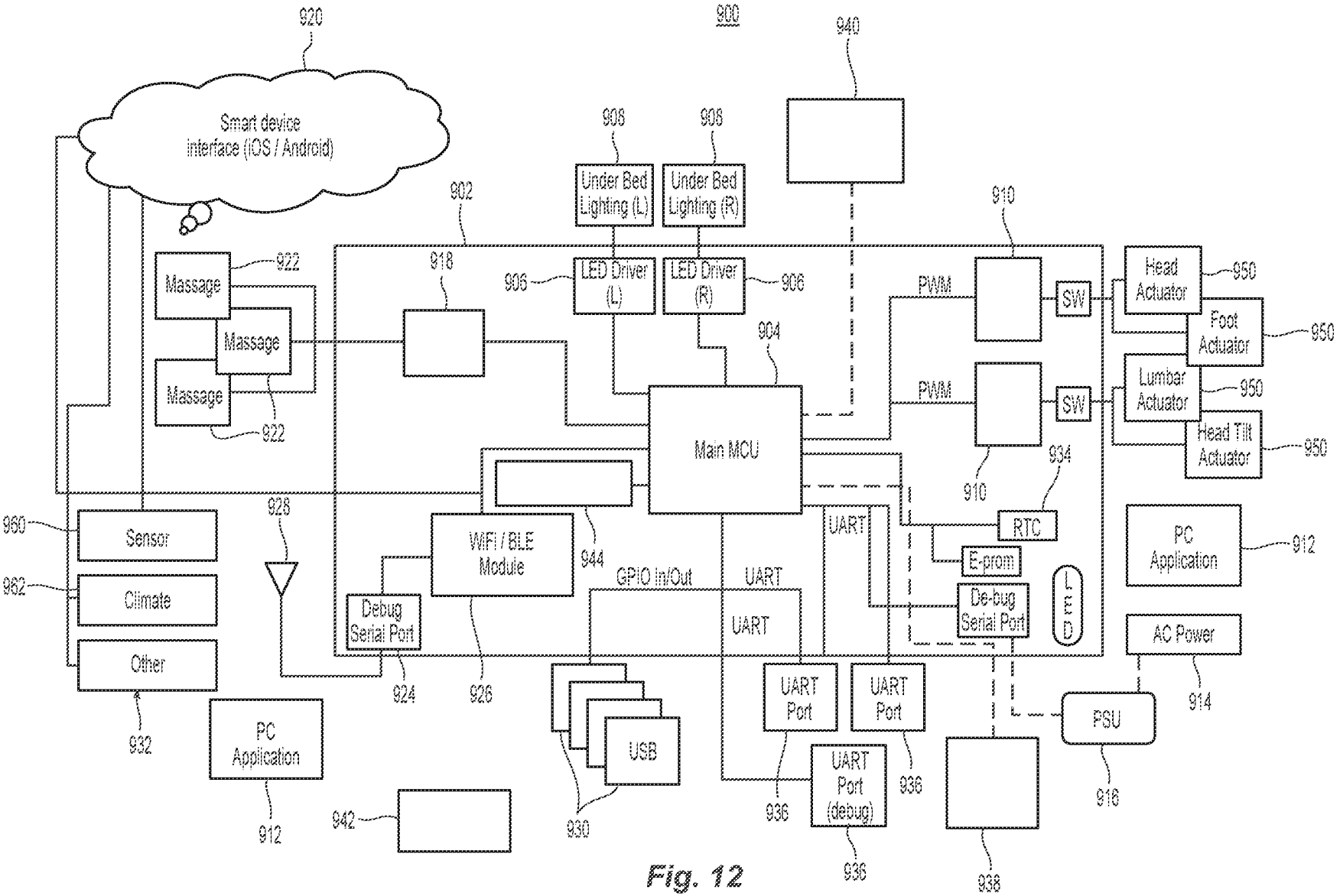
FIG. 12 is a schematic representation of an embodiment of an operational control system for the climate control system.

Referring to FIG. 12, an exemplary embodiment of an operational control system 900 for use in the climate control system is illustrated. The operational control system can be located in one or more control boxes. In one embodiment, at least a portion of the operational control system is integrated into the multi-layered mattress. In another embodiment, the operational control system is separate from but located proximate to the multi-layered mattress. In one embodiment, the control boxes containing the operational control system are located remote from the multi-layered mattress and the heating mechanism and cooling mechanism components located within the multi-layered mattress and are in communication with the heating and cooling mechanisms of the mattress through direct wired or wireless links or across one or more local or wide area networks.

As illustrated, the operational control system includes at least one control panel circuit board 902 having at least one main or central processing unit 904 capable of executing one or more software applications to provide all of the desired functionality to the mattress and bed including the climate control functionality and the adjustability of adjustable bed frames and mattresses. Suitable processing units are known and available in the art and include programmable logic controllers.

The central processor or processing unit is in communication with the heating mechanisms 938 and the cooling mechanisms 940 to control these mechanisms in concert to achieve the desired climate conditions in the different zones of the mattress. In one embodiment, the processor is in communication with the heating mechanism and cooling mechanism through a direct wired communication. In one embodiment, communication is provided by a wireless communication module 926 located in the operational control system. Suitable wireless communication modules include, but are not limited to, WIFI, cellular and Bluetooth modules. In one embodiment, the operational control system includes at least one antenna 928 in communication with the operational control system through a serial port 924 to provide improved wireless communication.

In one embodiment, the operational control system includes a plurality of physical communication connections including a plurality of universal serial bus ports 930 and universal asynchronous receiver and transmitter ports 936. The communication mechanisms of the operational control system allow the operational control system to utilize smart devices 920 for data gathering and for operational control of the operational control system and other devices. Suitable smart devices include, but are not limited to, cellular phones, smart phones, personal computers and tablet computers. In one embodiment, the smart devices utilize web-based interfaces. In one embodiment, the smart devices utilize applications running on those devices. The smart devices are in communication with the operational control system and with other devices, systems and sensors across one or more networks for data gathering and operational control. In one embodiment, the smart devices, and therefore, the operational control system are in communication with a plurality of sensors 960, for example, thermostats, thermometers and thermistors, and with other climate data sensors 962 such as relative humidity sensors. These sensors are used to gather data from either directly, across a network or through the smart devices. In one embodiment, the smart devices and operational control system are in communication with other devices 932. These other devices include, but at not limited to, programmable and remotely controllable thermostats.

In one embodiment, the operational control system is in communication with one or more software applications 912 running on computers or other personal computing devices. These software applications can provide additional functionality or information to the operational control system, for example, predicted temperature data or computation of user sleep patterns. In one embodiment, the operational control system is in communication with one or more dedicated remote-control devices 942.

In one embodiment, the operational control system includes one or more displays or input/output devices 944. Suitable input/output devices include, but are not limited to, displays, lights, touch screen displays, key pads and point-and-click devices. The operational control system includes a power supply unit 916 that is in communication with an AC power source 914. In one embodiment, the operational control system operates on DC power and includes a battery such as a rechargeable battery. In one embodiment, the operational control system includes a real time clock 934 in communication with the control unit.

In one embodiment, the operational control system controls all functions of a bed or adjustable bed. In one embodiment, the operational control system includes massage control circuitry 918 in communication with the control unit and a plurality of massage motors or actuators 922. In one embodiment, a plurality of LED drivers 906 are provided in communication with the control unit and one of more LED lights 908 such as under bed LED lights. In one embodiment, a plurality of motor drivers 910 is provided in communication with the control unit and a plurality of actuators 950 in an adjustable bed. Therefore, the operational control system provides the ability for full operational control, including both automatic and remote operational control of the climate control system and other functions of the bed or other multi-layered device that contains the climate control system.

Figure 13:
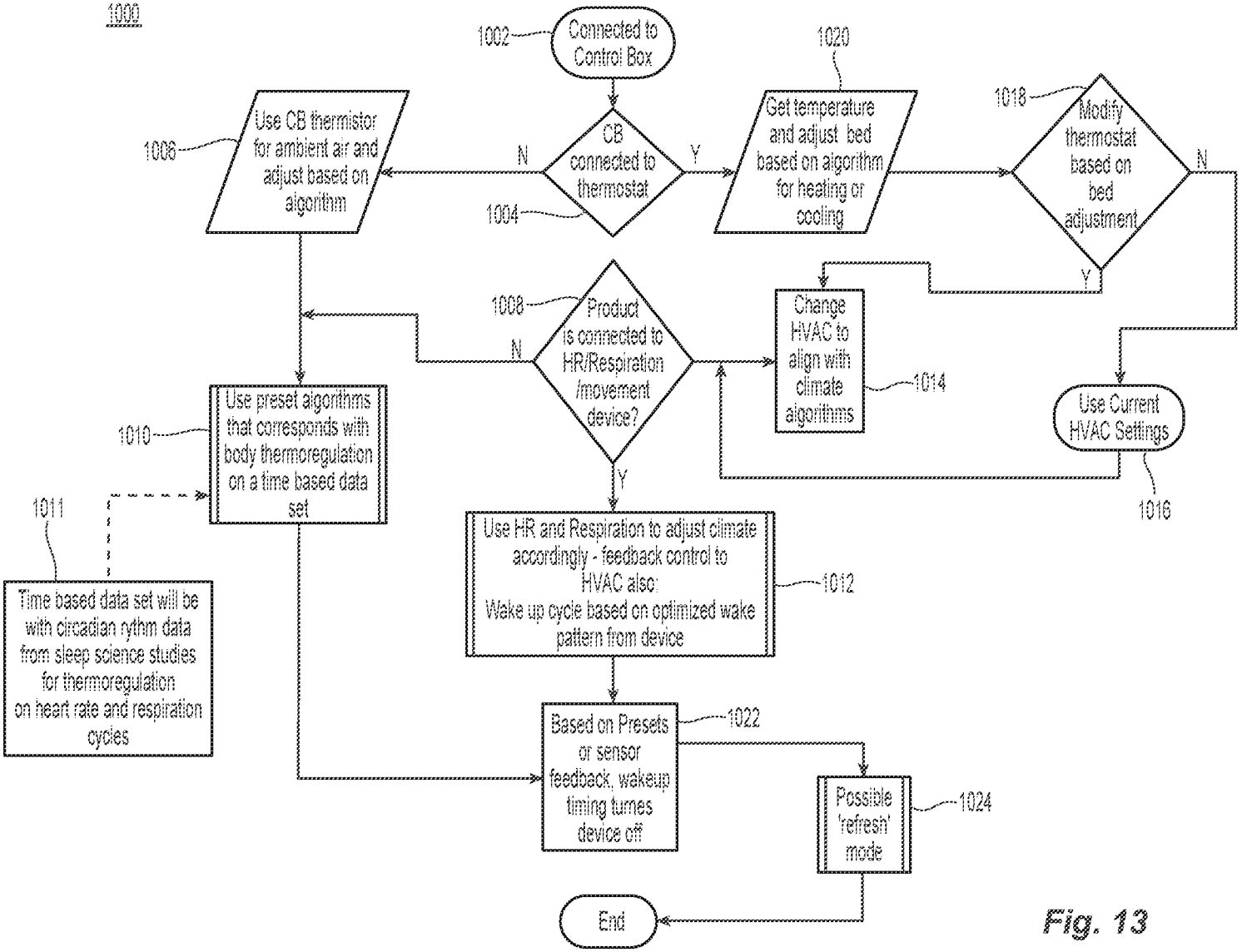
FIG. 13 is a flow chart illustrating an embodiment of control logic for use in controlling the operational control system.

Referring to FIG. 13, an embodiment of control logic 1000 executed by the operational control system to set and control and the heating mechanism, the cooling mechanism and other ancillary devices is illustrated. In one embodiment, a user is connected to the operational control system 1002 and the control box containing the operational control system, for example, using a PC, a dedicated wired or wireless remote control or a smart device. This connection is used to start the operational control system and to provide operating parameters to be used by the operational control system. These operating parameters include and identification of the user, user-defined preferences, and a history of sleep patterns and sleep preferences associated with the user. The user can also select established operational algorithms to be used by the operational control system.

The operational control system determines whether the operational control system is in communication with a thermostat 1004 that is monitoring the ambient environment in the room or area in which the climate control mattress is located. In one embodiment, this thermostat controls the operation of the HVAC system associated with the ambient environment. If the operational control system is not in communication with the thermostat, then the operational control system obtains the ambient room temperature using a thermistor 1006 contained in the operational control system, for example, located on an exterior surface of the mattress.

The heating and cooling mechanisms are then controlled in accordance with the software algorithm selected by the user and executed by the operational control system. In one embodiment, a pre-defined algorithm is used that provides body thermoregulation, i.e., heating and cooling and climate control, in accordance with a time-based data set 1010. In one embodiment, the time-based data set is generated based on circadian rhythm data obtained, for example, from sleep science studies for thermoregulation on heart rate and respiration cycles 1011. Therefore, the initial climate control settings are determined and set and then operated and adjusted over time and for a duration corresponding to the natural sleep patterns of the user.

The heating and cooling mechanisms are then controlled based on the presets and continued sensor feedback, making the necessary adjustments and turning the heating and cooling mechanisms on and off in accordance with a desired and determined wake-up timing 1022. If desired, the operational control system can operate in an optional refresh mode after wakeup timing passes 1024. This optional refresh mode operates to refresh or wake-up the occupant.

If it is determined that the operational control system is in communication with a thermostat, then the ambient room temperature is obtained from the thermostat and the heating and cooling mechanisms are adjusted in accordance with a selected algorithm for controlling the climate conditions of the multi-layered mattress 1020. In one embodiment, connection to the thermostat provides for both monitoring the temperature of the ambient environment and controlling the operation of the HVAC system. Therefore, a determination is made regarding whether an adjustment to the heating or cooling of the ambient environment is desired. In on embodiment, a determination is made regarding whether the HVAC system or the thermostat should be adjusted based on adjustments made to the climate conditions on the multi-layered mattress 1018. If no ambient temperature adjustments are to be made, then then current HVAC system settings of the thermostat are maintained 1016. If changes to the HVAC are desired, then the HVAC system settings are adjusted to align with the heating and cooling mechanism settings, climate conditions and the control algorithms of the operational control system 1014.

A determination is then made regarding whether the operational control system is in communication with a heart rate, respiration or movement monitoring device 1008. If the operational control system is not connected to one of these devices, then the heating and cooling mechanisms are controlled in accordance with the software algorithm executed by the operational control system. In particular, a pre-defined algorithm is used that provides body thermoregulation, i.e., heating and cooling and climate control, in accordance with a time-based data set 1010. In one embodiment, the time-based data set is generated based on circadian rhythm data obtained, for example, from sleep science studies for thermoregulation on heart rate and respiration cycles 1011. Therefore, the initial climate control settings are determined and set and then operated and adjusted over time and for a duration corresponding to the natural sleep patterns of the user. The heating and cooling mechanism are then controlled based on the presets and continued sensor feedback, making the necessary adjustments and turning the heating and cooling mechanisms on and off in accordance with a desired and determined wake-up timing 1022. If desired, the operational control system can operate in an optional refresh mode after wakeup timing passes 1024.

If the operational control system is in communication with a heart rate, respiration and movement monitoring device, then heart rate and respiration are used to adjust operation of the heating mechanism and cooling mechanism and also to provide feedback to the HVAC system controlling the ambient environment 1012. A wakeup cycle is then determined based on an optimized wake pattern derived from the heart rate, respiration and movement monitoring device. The heating and cooling mechanism are then controlled based on the presets and continued sensor feedback, making the necessary adjustments and turning the heating and cooling mechanisms off in accordance with a desired and determined wake-up timing 1022. If desired, the operational control system can operate in an optional refresh mode after wakeup timing passes 1024.

Figure 14:
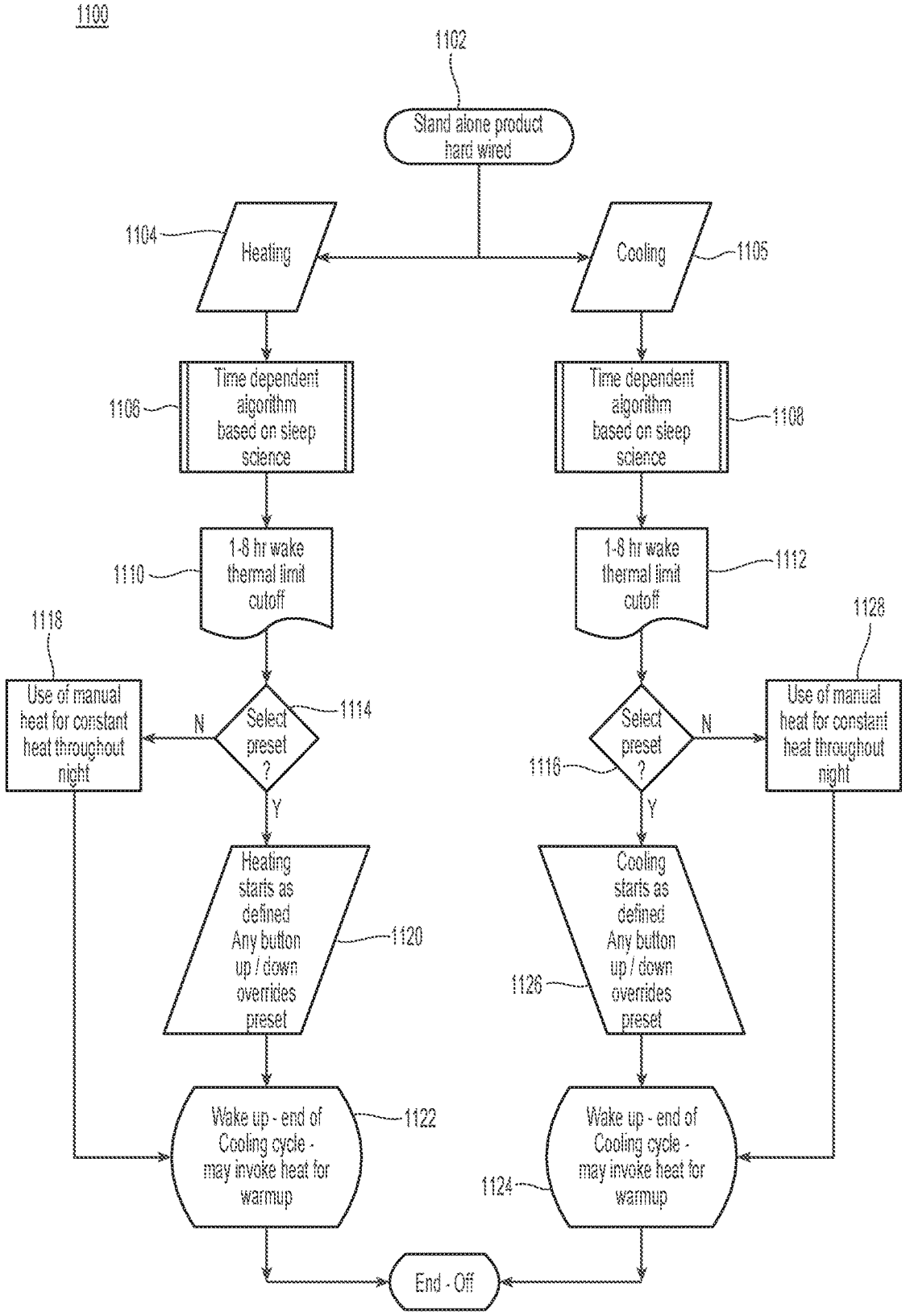
FIG. 14 is a flow chart illustrating another embodiment of control logic for use in controlling the operational control system.

Referring now to FIG. 14, another exemplary embodiment of control logic 1100 used by the operational control system to set and control and heating and cooling mechanisms is illustrated. As illustrated, the control logic is applied to a stand-alone climate control system that has the logic and control functions hard wired into the operational control system 1102. For controlling the heating mechanism 1104, a time dependent algorithm is identified that is based on sleep science data 1106, and a thermal limit timing cut-off of from about 1 hour to about 8 hours is determined 1110. This establishes the preset and hard-wired operational parameters. The user selects whether or not to use the present operational parameters 1114. If the user decides not to use the preset parameters for climate control and timing, then the user manually enters a desired constant heating level that is used throughout the night or the duration of sleep 1118. If the preset heating levels and timing are selected, then the climate control system is operated in accordance with these presets 1120. However, the preset parameters can be overridden at any time, for example, by selecting a heat up or heat down button on an associated remote control. The heating is then stopped in accordance with the desired or preset wake up timing 1112. If the temperature of the mattress or contact surface was cooled during the night or duration of sleep, then in one embodiment, the wake-up timing can initiate a brief warm-up prior to or concurrent with wake up.

For controlling the cooling mechanism 1105, a time dependent algorithm is identified that is based on sleep science data 1108, and a thermal limit timing cut-off of from about 1 hour to about 8 hours is determined 1112. In one embodiment, the same data and settings as for the heating mechanism are utilized. In one embodiment, the heating and cooling mechanisms are controlled in concert or in combination to achieve, set and maintain the desired or present climate conditions on the contact surface including temperature and humidity. This establishes the preset and hard-wired operational parameters for the cooling system. The user can then select whether or not to use the present operational parameters 1116. If the user decides not to use the present parameters for climate control and timing, then the user manually enters a desired constant cooling level that is used throughout the night or the duration of sleep 1128. If the preset cooling levels and timing are selected, then the climate control system is operated in accordance with these presets 1126. However, the preset parameters can be overridden at any time, for example, by selecting a heat up or heat down button on remote control. The cooling is then stopped in accordance with the desired or preset wake up timing 1124. If the temperature of the mattress or contact surface was cooled during the night or duration of sleep, then in one embodiment, the wake-up timing can initiate a brief warm-up prior to or concurrent with wake up.

Figure 15:
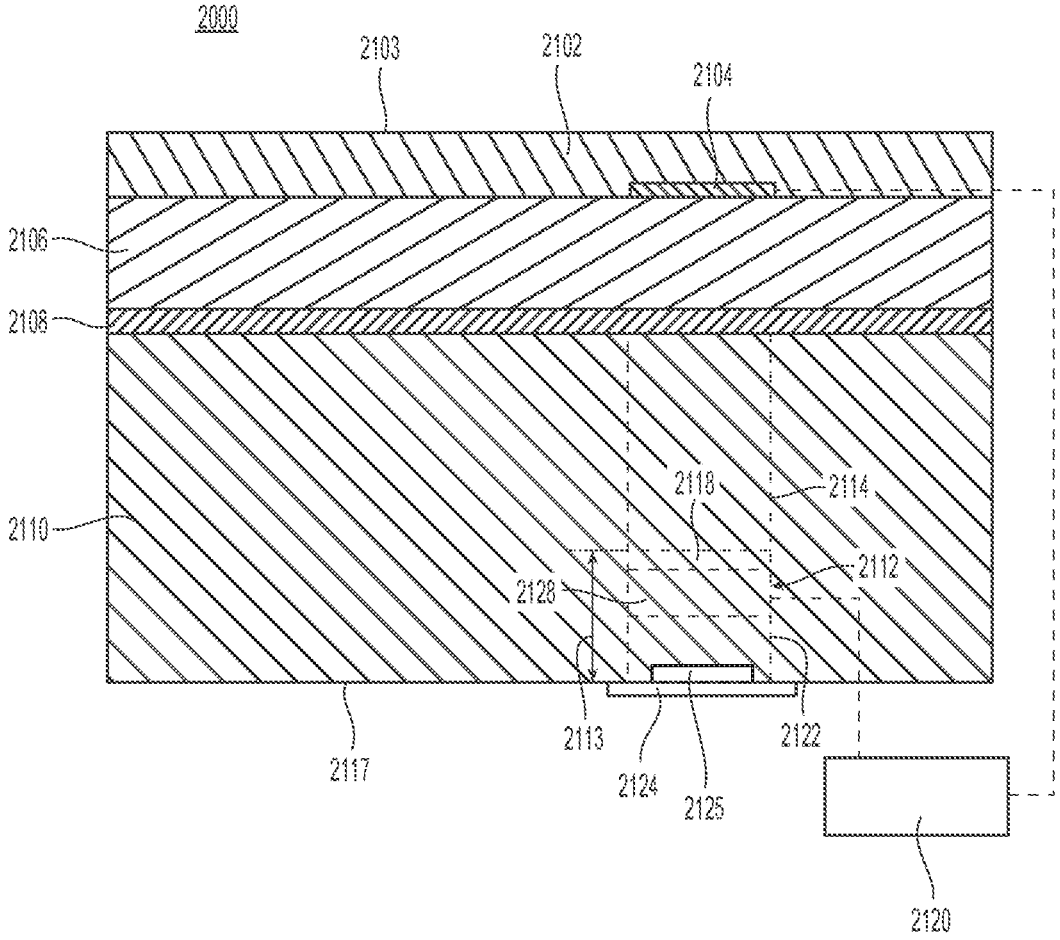
FIG. 15 is a schematic illustration of another embodiment of a climate control system in a multi-layered structure.

Referring now to FIG. 15, another embodiment of a climate controlled multi-layered structure or climate controlled multi-layered mattress 2000 is illustrated. The mattress includes the contact surface 2103 and the bottom surface 2117 opposite the contact surface. Between the contact surface and the bottom surface, the multi-layered mattress includes the plurality of individual and distinct layers. These layers include a first top layer 2102. The top layer includes the outer face 2103 or contact surface of the mattress. Suitable materials for the top layer include, but are not limited to foam. Preferably, the top layer is cool touch air memory foam. The top layer has a thickness of up to about 1 inch. As discussed herein, the top layer is perforated or ventilated to provide for the air flow utilized by the cooling mechanism. Suitable arrangements of perforations, vents or vent holes are discussed above. In one embodiment 0.4 inch (10 mm) holes are provided through the top layer and are located every 2 inches across the length and width of the top layer in the area of the top layer containing perforations.

The multi-layered mattress containing the climate control system includes second layer 2106 located under the first top layer. Suitable materials for the second layer include foam. Preferably, the second layer is memory foam. The second layer has a thickness of up to about 2.5". As with the top layer, the second layer is ventilated or perforated to facilitate air flow. Suitable types and arrangements of perforations, vents or vent holes in the second layer are the same as those for the top layer. The pattern of vent holes in the first and second layers can be the same and overlap or can be different.

Figure 16:
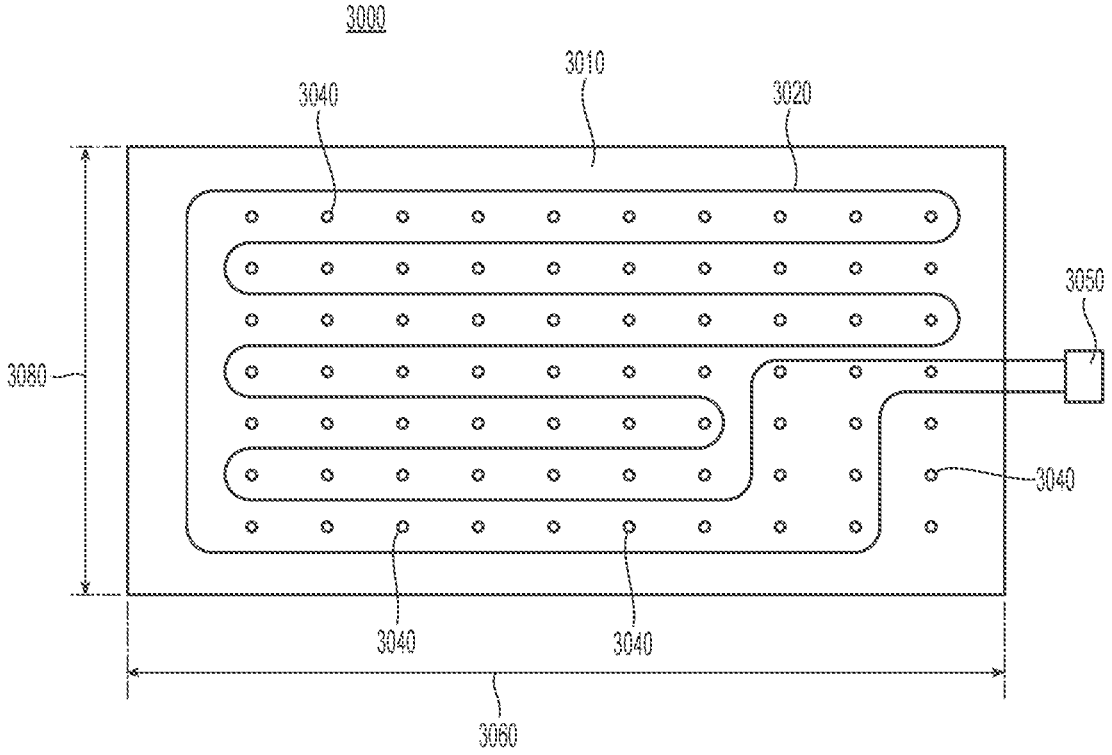
FIG. 16 is a schematic illustration of an embodiment of a heating pad for use in the heating mechanism.

The heating mechanism 2104 is disposed between the top layer and the second layer. As illustrated, the heating mechanism does not cover the entire area between the top layer and the second layer but occupies a portion of the area between the top layer and the second layer. In one embodiment, the heating mechanism occupies a plurality of separate portions of the area between the top layer and the second layer. Referring to FIG. 16, an embodiment of heating mechanism 3000 is illustrated. The heating mechanism is arranged as a single pad occupying an area up to the area between the top layer and the second layer. In one embodiment, the heating mechanism includes a plurality of pads. Each pad includes a web of material 3010. Suitable materials include flame resistant fabrics. In one embodiment, each pad has a length 3060 of up to about 18 inches and a width 3080 of up to about 10 inches. Preferably, each heating pad is 10 inches by 18 inches. A heating element 3020 is looped through and contained within the web of material. In one embodiment, the heating element is a wire. The number of loops and amount of the heating element is varied depending on the amount of heating to be provided by the heating pad. In one embodiment the heating element is one or more threads that are looped through or woven into the web of material. The heating element includes a connector 3050 for connection to at least one of a power source and the operational control system. Each pad includes a plurality of holes 3040 passing through the web of material. These holes facilitate air flow through the heating pad for the cooling mechanism.

Returning to FIG. 15, the mattress includes a support layer 2108 in contact with the second layer opposite the top layer. The support layer has a thickness of only up to about 0.4 inches or 1 cm. The support layer prevents deformation of the layers of the multi-layered mattress that could impede air flow through the vent holes, open cell foams, perforations and channels of the multi-layered mattress and climate control system. This ensures proper air flow through the multi-layered mattress. Suitable materials for the support layer include, but are not limited to reticulated foam or an air mesh.

The multi-layered mattress containing the integrated climate control system includes the third layer 2110, or base layer, disposed under the support layer. Suitable materials for the third layer include foam. Preferably, the foam has a density and porosity sufficient to support the upper layers and components of the climate control system and to direct air flow through the channels. In one embodiment, the foam material is a large open cell foam.

In one embodiment, the third layer has a thickness of up to about 7.25 inches. In one embodiment, at least a portion of the cooling mechanism of the climate control system is contained within or integrated into the third layer. Therefore, the third layer includes at least one channel 2114 passing completely through the third layer. Alternatively, the third layer includes a plurality of separate and distinct channels at different locations within the third layer corresponding to separate zones across the contact surface of the multi-layered mattress. In one embodiment, each channel in the plurality of channels is located within zones that correspond to the zones for the vent holes in the top layer. Suitable cross-sectional shapes for each channel include, but are not limited to, circular, oblong, rectangular and square. Suitable shapes, sizes and arrangements of each channel are the same as those for the channels discussed herein in association with other embodiments. The channel has a length equal to the thickness of the third layer.

Figure 17:
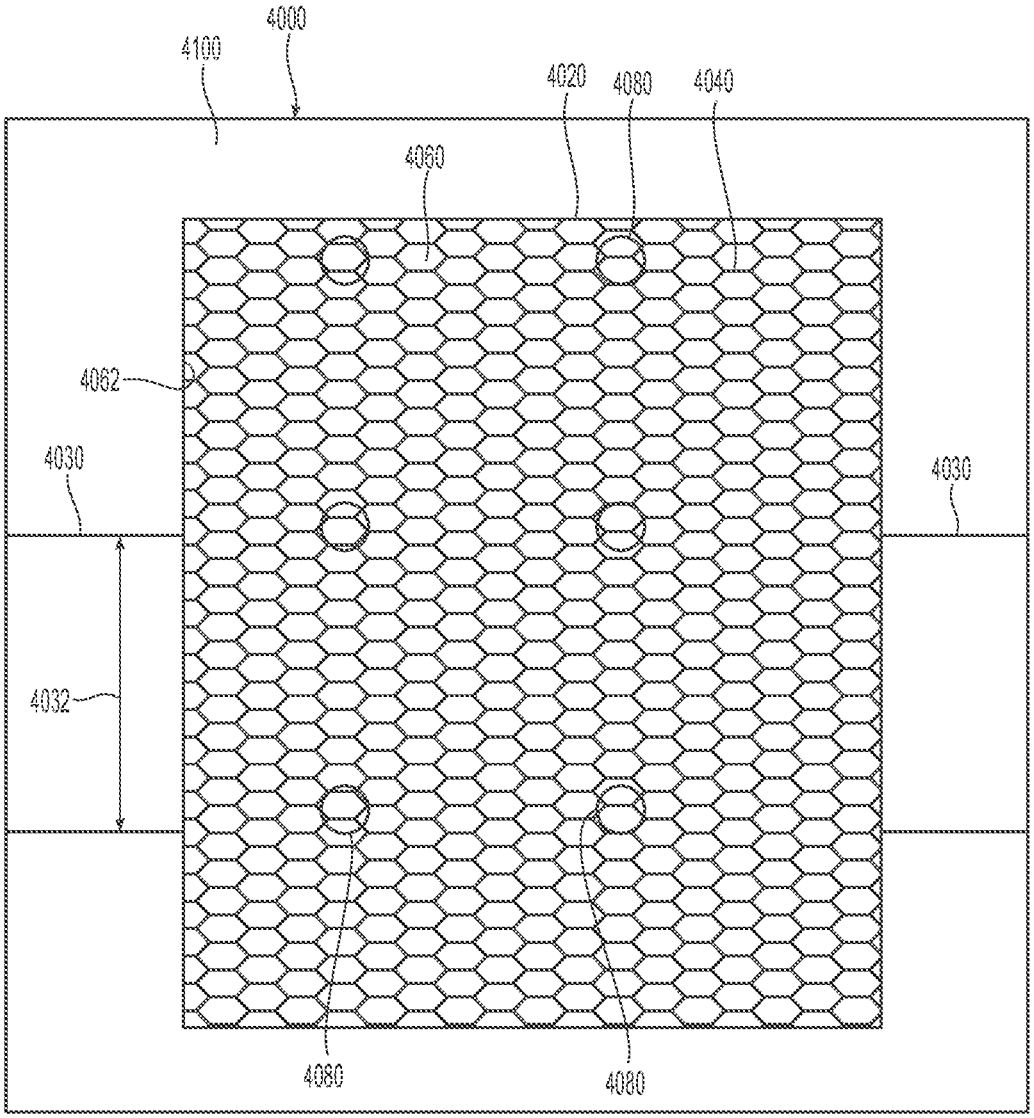
FIG. 17 is a schematic representation of a channel and exhaust ports in a bottom surface of a third layer of the multi-layered mattress.

Referring to FIG. 17, a portion of the bottom surface 4100 of the third layer 4000 containing a channel 4020 is illustrated. As illustrated, the channel has a rectangular cross section and extends completely through the third layer, exposing the support layer 4040. As illustrated, the support layer is an air mesh. Therefore, the second layer 4060 and at least a portion of the vent holes 4080 passing through the second layer are exposed to the channel. A plurality of exhaust conduits 4030 are provided in communication with the channel. In one embodiment, each exhaust conduit extends from an edge 4062 of the channel to one of the head end, foot end or side of the third layer of the multi-layered mattress. In one embodiment, the support layer prevents excessive compression or collapse of each exhaust conduit. Each exhaust conduit provides a route for air flow out the sides or ends of the multi-layered mattress adjacent and above the bottom surface of the multi-layered mattress. Exhausting air from the sides and ends allows use of the multi-layered mattress with a solid fixed or articulating bed frame. In addition, the exhaust conduit provides an electrical chase for the elements of the heating mechanism, the cooling mechanism and the operational control system.

Each exhaust conduit extends only partially into the bottom surface 4100 of the third layer. In one embodiment, each exhaust conduit extends into the third layer only a portion of the thickness of the third layer. In one embodiment, each exhaust conduit extends into the bottom surface of the third layer to a depth of from about 1 inch (28 mm) to about 1.25 inches (32 mm), preferably about 1.18 inches (30 mm). In one embodiment, each exhaust conduit has a width 4032 of up to about 4 inches (100 mm). In one embodiment, each exhaust conduit is formed as a plurality of separate parallel conduits. Each separate parallel conduit has a width of from about 0.9 inches (23 mm) to about 1.1 inches (27 mm), preferably about 0.98 inches (25 mm). Adjacent parallel conduits are separated by walls having a thickness of afro about 0.4 inches (10.5 mm) to about 0.6 inches (14.5 mm), preferably about 0.49 inches (12.5 mm). Each exhaust conduit provides from about 69 inches (1750 mm) to about 89 inches (2,250 mm) of air moving space.

Returning to FIG. 15, in one embodiment, the climate-controlled multi-layered mattress includes at least one fan assembly 2112 that extends into the third layer from the bottom surface a given distance 2113. In one embodiment, the given distance is about 3.25 inches. Each fan assembly includes a fan box 2122 portion. Each fan assembly includes a mounting bezel or mounting flange 2124 attached to one end of the fan box. In one embodiment, the mounting flange rests on the bottom surface 2117. Alternatively, the mounting flange is flush with the bottom surface. The mounting flange is a solid plate that does not permit air flow from the fan box to pass through the bottom surface of the third layer. The fan box includes a port or scoop 2125, which is an opening in the fan box. When installed in the channel, the scoop 2125 is aligned with one of the exhaust conduits to direct the flow of air from the fan assembly through that exhaust conduit. The fan assembly includes a fan 2128 or fan blades attached to the fan box opposite the mounting flange or mounting bezel. Suitable fans include DC fans, for example, computer cooling fans. A fan shroud 2118 is attached to the fan opposite the fan box. As discussed above, the remaining length of the channel can be left open or filled with a foam plug.

Figure 18:
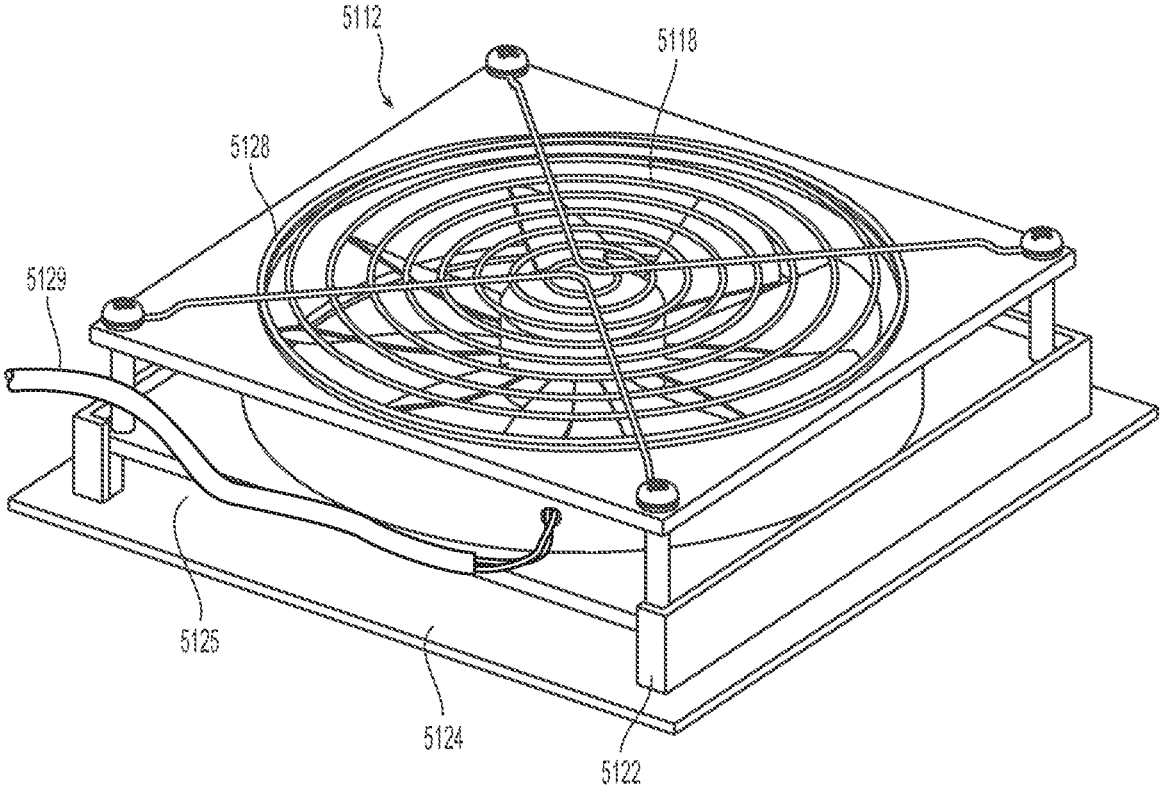
FIG. 18 is a perspective view of another embodiment of a fan assembly.

Referring now to FIG. 18, an exemplary embodiment of a fan assembly 5112 is illustrated. The fan assembly includes the fan box 5122 having a sufficient length to extend the fan assembly desired depth into the channel of the third layer. As illustrated, the fan box has a rectangular cross-section and includes the scoop 5125, which is an opening on one side of the fan box. The scoop is sized in accordance with the size of the exhaust conduits and provides a passage for air flow out of the fan box and through one of the exhaust conduits. In one embodiment, the fan box includes a plurality of scoops located on different sides of the fan box. The mounting bezel or mounting flange 5124 is attached to one end of the fan box. In one embodiment, the mounting flange is formed as part of the fan box. In one embodiment, the mounting flange is larger than the fan box and has a size and shape larger than the size and shape of the channel. The mounting bezel engages the bottom surface of the third layer.

In one embodiment, the fan assembly includes the fan 5128 placed on the fan box opposite the mounting flange. Suitable fans include DC powered electric fans and cooling fans. The fan is in communication with, controlled by and provided power by the operational control system through wires 5129. In one embodiment, the fan is about 2.75 inches (70 mm) square and has a thickness of about 1 inch (25 mm). In one embodiment, the fan is capable of moving 22 CFM of air, 1090 liters ft/min. In one embodiment, the fan assembly includes a fan shroud 5118 located over the fan. The fan shroud protects the fan and prevents debris from falling into the fan and foam layers from being deformed into the fan. Suitable materials for the fan shroud include metal and plastic. The fan assembly can also include a filter placed over the fan shroud or between the fan and the fan shroud.

Figure 19:
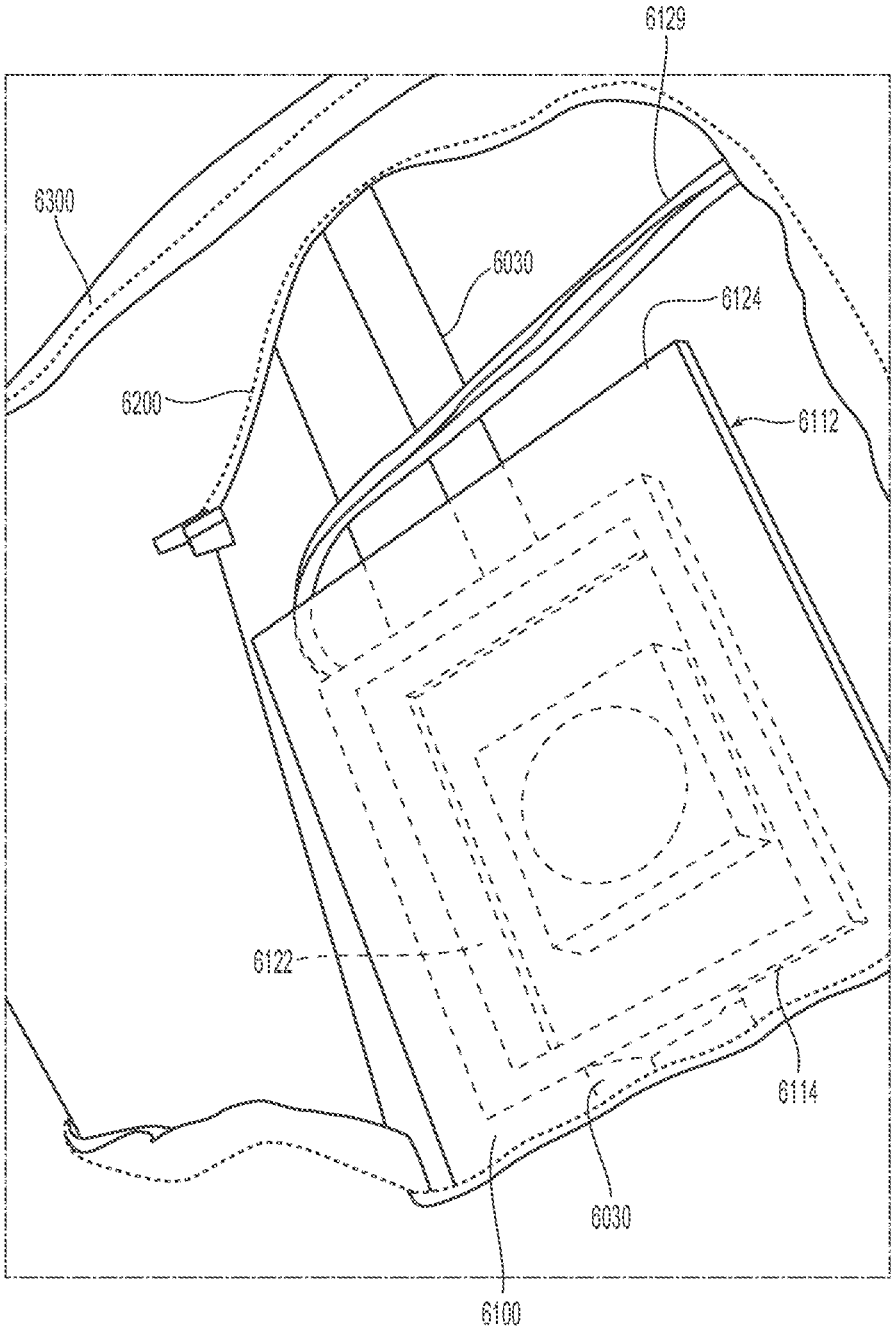
FIG. 19 is a view of the fan assembly inserted into the channel of the third layer with the zippered panels open.

Referring to FIG. 19, the fan assembly 6112 is placed in the channel 6114 such that the mounting flange 6124 engages the bottom surface 6100 of the third layer. The fan box 6122 extends into the channel with the scoop aligned with one of the exhaust conduits 6030. The wires 6129 attached to the fan can also be routed through one of the exhaust conduits. Access for installation, service and removal of the fan assembly is provided by a first zipper panel 6200 in the fire sock and a second zipper panel 6300 through the lower breathable panel. Both the first sock and the lower breathable panel are configured to have sufficient air permeability to accommodate the flow of air for the cooling mechanism.

Figure 20:
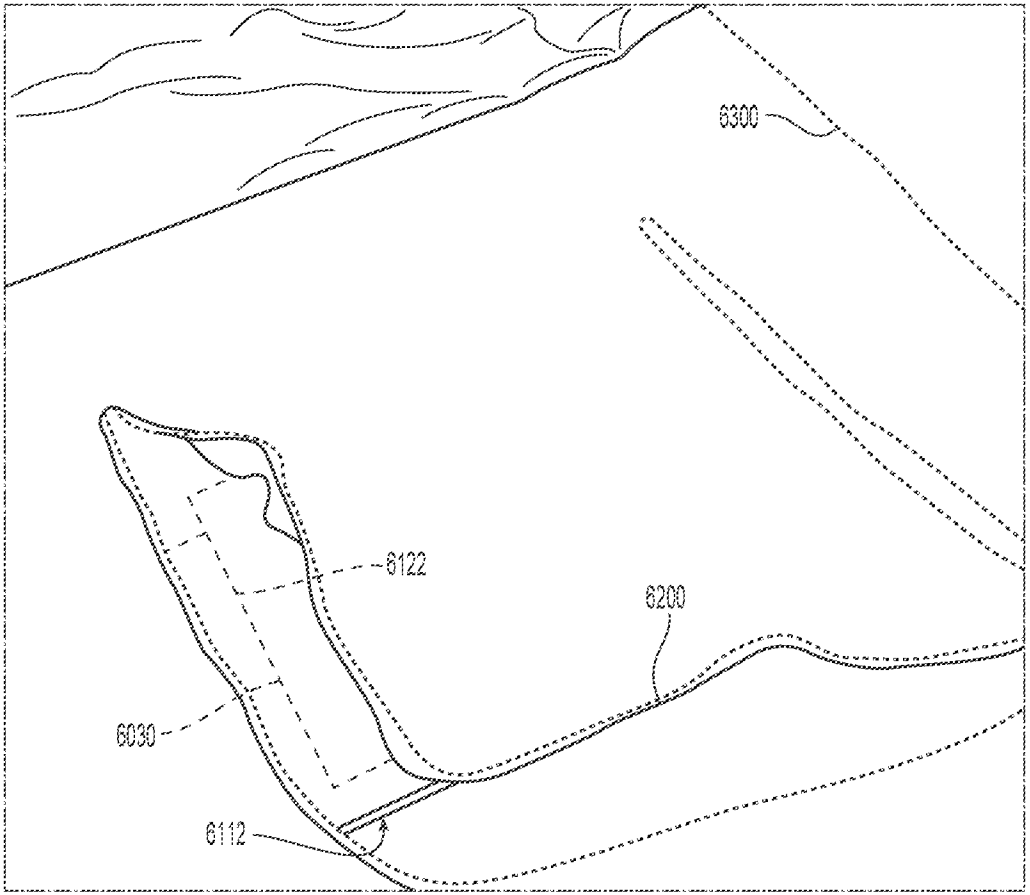
FIG. 20 is a view of the fan assembly inserted into the channel of the third layer with the fire sock zippered panel partially closed and the breathable layer zippered panel open.
Figure 21:
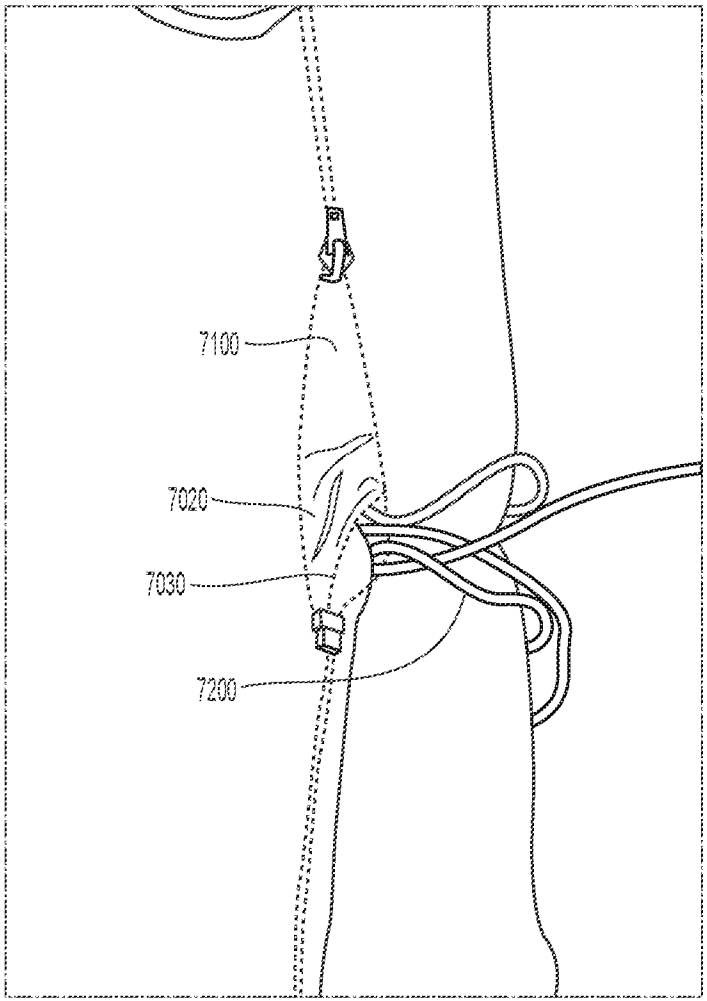
FIG. 21 is a view of an bottom edge of the third layer with edge zippered panels providing access to wiring for the heating and cooling mechanisms.

Referring to FIG. 20, the first zipper panel 6200 is closed followed by the second zipper panel 6300 to conceal the fan assembly 6112. As illustrated in FIG. 21, the wires 7200 for at least one of the fan assemblies, the heating mechanism and sensors located within the multi-layered mattress are routed through the exhaust conduits and out a fire sock edge zipper slot 7030 and a breathable panel edge zipper slot 7020 located along a third layer bottom surface edge 7100. These wires are then routed connected to the operational control system that is mounted, for example, in the bed frame.

Returning to FIG. 15, the operational control system 2120 is provided in communication with the heating mechanism, including the heating elements, and the cooling mechanism, including the fan assembly. In one embodiment, the operational control system provides power and control to the components of the heating mechanism and the cooling mechanism. In one embodiment, the heating mechanism and cooling mechanism are considered part of the operational control system. The operational control system achieves the desired climate conditions at the contact surface of the multi-layered mattress. In one embodiment, the operational control system is disposed within one or more of the layers of the multi-layered mattress. In one embodiment, the operational control system is located between one or more layers of the multi-layered mattress.

In one embodiment, the operational control system is located outside of the mattress and is in communication with the heating mechanism and the cooling mechanism through one or more wired or wireless connections. For example, the operational control system is located within the foundation, either a stationary foundation such as a box spring or an adjustable foundation, which is used to support the multi-layered mattress. In one embodiment, the operational control system is provided in conjunction with or as a modification to the systems used to provide the operations of an adjustable bed foundation. In one embodiment, the operational control system is standardized across adjustable bed foundations to facilitate the use of a multi-layered mattress containing the heating mechanism and the cooling mechanism with multiple adjustable foundations. This embodiment also facilitates the replacement of a multi-layered mattress. In one embodiment, the foundation supporting the multi-layered mattress includes vents or passages to facilitate the air flow from the multi-layered mattress.

Figure 22:
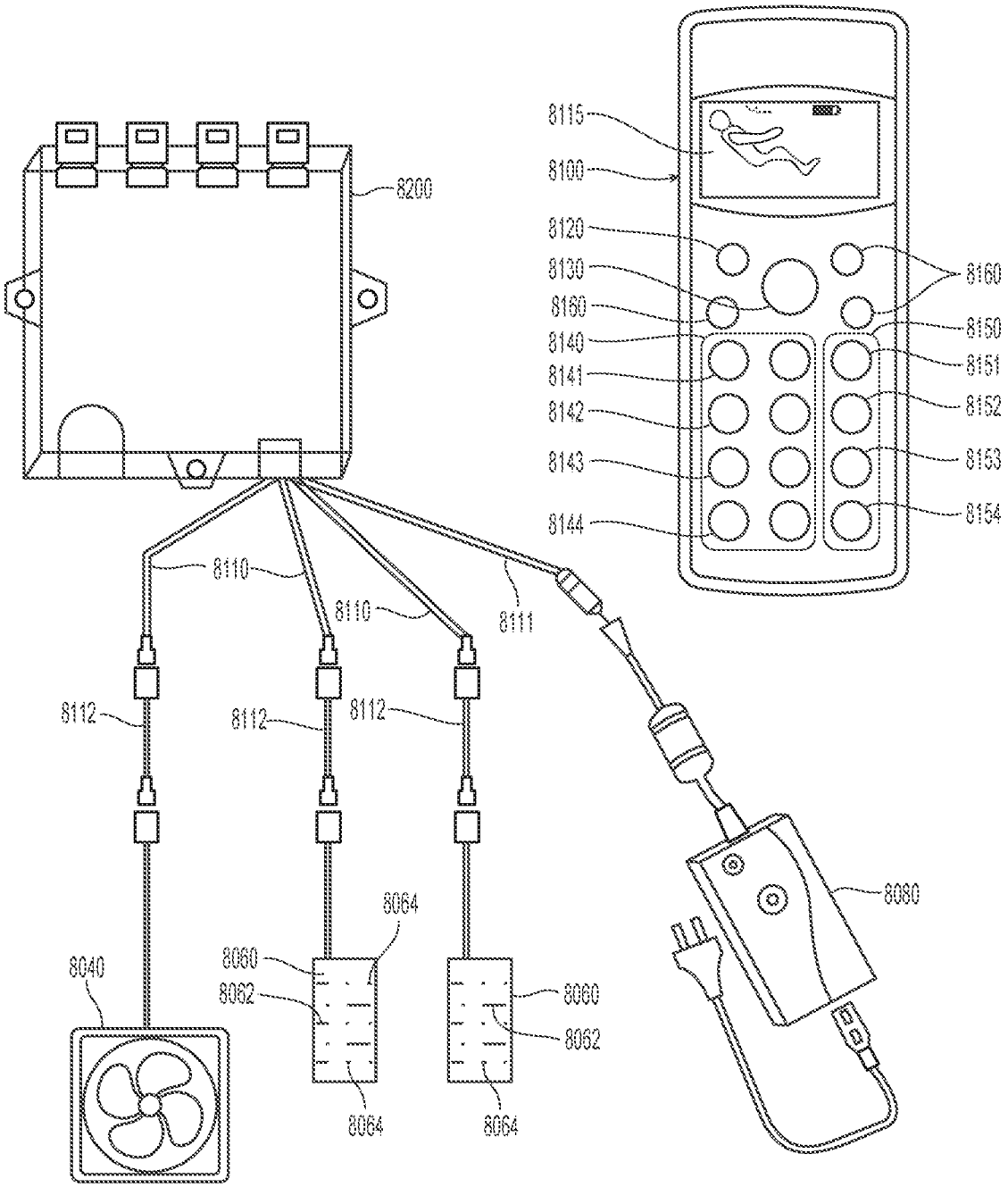
FIG. 22 is a schematic representation of another embodiment of an operational control system for the climate control system with wireless remote.

Referring now to FIG. 22, an exemplary embodiment of various components of an operational control system in combination with a remote, cooling elements and heating elements is illustrated. As illustrated, the operational control system includes a control box 8020, for example, a custom programmable control box. The control box includes a logic control unit or processor and memory storing executable programs that when executed provide the functions of the climate control system. In general, the control box can provide any of the functionality as illustrated, for example, in FIG. 12 and houses the circuit board illustrated in FIG. 12. The control box includes a plurality of communication port leads 8110 and a plurality of extending cables 8112 to connect the communication port leads to the components of the heating mechanism and the cooling mechanism. This includes the fan 8040, and a plurality of heating pads 8060, each containing the heating coils 8062 and vent holes 8064 passing through the heating pad. A power supply 8080 is connected to the control box through a power cable lead 8111.

The control box is in communication with a wireless remote 8100 using wireless communication technologies such as Blue Tooth. The wireless remote provides a display screen 8115 that displays, for example, current setting and climate control conditions on the contact surface of the multi-layered mattress. The display can also provide information on the current operation of the heating elements and fan, connection signal strength and battery level. In one embodiment, the display is a touch screen display that can display multiple screens and is used to input information, settings and instructions to the control box.

In one embodiment, the wireless remote includes a power button 8130 to turn the climate control system on and off, and a mode button 8120 to select present sleeping or operational modes for the climate control system include modes set, for example, by circadian rhythms. In addition to buttons providing to the selection of preset programs, the wireless remote includes manual heating mechanism controls 8140 and manual cooling mechanism controls 8150. In one embodiment, heating mechanism controls are provided for each heating element and include, a power button 8141 to turn each heating mechanism on and off, a low heating button 8142, a medium heating button 8143 and a high heating button 8144. Buttons could also be provided to allow the user to select a given heating temperature. Temperature can be monitored by the operational control system using a temperature sensor or by monitoring the current consumed by a heating element over time. The cooling mechanism controls include a power button to turn on and off one or more fans 8151, a low fan speed button 8152, a medium fan speed button 8153 and a high fan speed button 8154. The wireless remote can include additional buttons 8160 that access functions such as turning on and off lights or the display, turning on and off a massage function, displaying or entering a current heart rate and selecting a duration of climate control, i.e., heating or cooling. In addition to using a custom wireless remote control, a wired remote control can be used or a smart phone or other computing device executing a climate control system application can be used.

Figure 23:
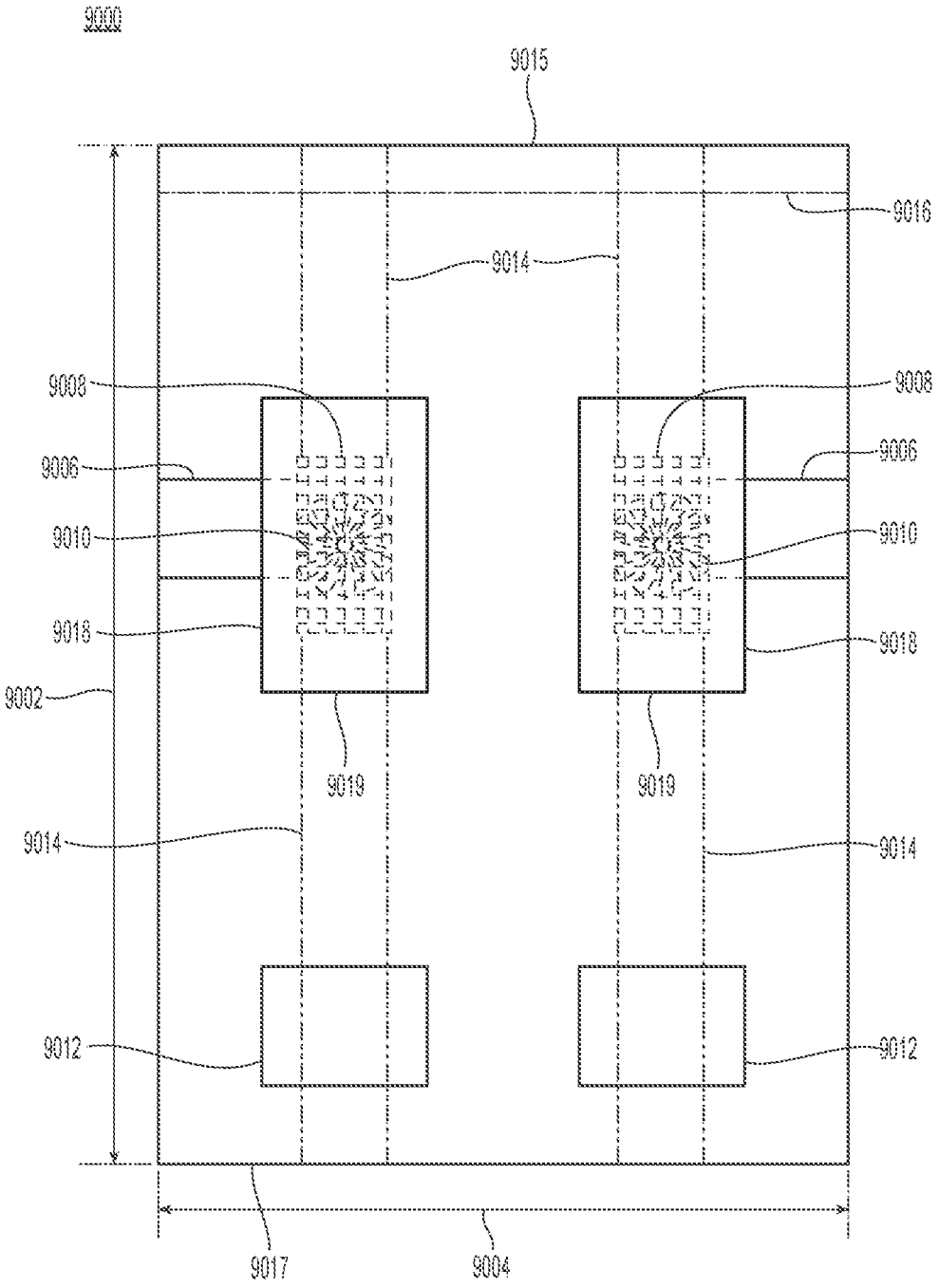
FIG. 23 is a schematic representation of the third layer showing locations of heating mechanisms and cooling mechanisms.

Referring now to FIG. 23, an embodiment of the layout of the third layer 9000 is illustrated. The third layer includes a length 9002 from the head end 9015 to the foot end 9017 and a width 9004 between pairs of opposing sides. For a queen size mattress the length is about 80 inches and the width is about 60 inches. A channel 9008 is located on either side of the third layer with a fan assembly 9010 disposed in each channel. For the location of the top of the head 9016 of an occupant of the bed that is spaced about 3 inches from the head end, the fan assembly 9010 located in each channel is centered about 52 inches from the foot end of the bed. An exhaust conduit 9006 that is in communication with the scoop in the fan assembly runs a distance from each channel to a side of the third layer. In one embodiment, this distance is about 14 inches. Additional or alternative exhaust conduits 9014 can also be provided running from the channels to the head end 9015 or the foot end 9017 of the third layer.

A heating pad 9018 is placed over each channel and positioned with the bottom 9019 of the heating pad located 39 inches from the foot end 9017 of the third layer. As illustrated, the heating pad occupies a larger area than the channel. In one embodiment, additional heating pads 9012 are provided on either side of the mattress in the foot area or foot zone of the third layer. These heating pads are arranged with their longer dimension parallel to the foot end of the third layer. In one embodiment, each heating pad is spaced about 6 inches from the closest side and about 7 inches from the foot end of the third layer. In one embodiment, all of the heating pads are separately and independently controllable. Therefore, the number of heating pads can be different than the number of channels, and heating pads can be provided in areas or zones without and associated channel or fan. In one embodiment, these zones correspond to body parts to which extra or independent heating is desired, e.g., head or feet.

Although the features and elements of the present exemplary embodiments are described in the embodiments in particular combinations, each feature or element can be used alone without the other features and elements of the embodiments or in various combinations with or without other features and elements disclosed herein. Any methods or flowcharts provided in the present application may be implemented in a computer program, software, or firmware tangibly embodied in a computer-readable storage medium for execution by a dedicated computer or a processor.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A climate control system comprising:

a heating mechanism disposed within a multi-layered structure and configured to supply heat to an outer contact surface of the multi-layered structure;

a cooling mechanism configured to pull air into the multi-layered structure from the outer contact surface through the multi-layered structure and away from at least a portion of the outer contact surface and the heating mechanism, the cooling mechanism separate from the heating mechanism; and an operational control system in communication with the heating mechanism and the cooling mechanism to operate the heating mechanism and the cooling mechanism to achieve desired climate conditions on the outer contact surface of the multi-layered structure.

2. The climate control system of claim 1, wherein:

the heating mechanism comprises at least one heating element; and the cooling mechanism is disposed between the at least one heating element and a bottom surface of the multi-layered structure opposite the outer contact surface and comprises:

at least one channel passing through at least one layer in the multi-layered structure; and a fan disposed in the at least one channel to pull air through the at least one channel away from the outer contact surface and past the bottom surface.

3. The climate control system of claim 2, wherein the at least one heating element comprises a coil, a wire, a thread or a cable disposed between two layers in the multi-layered structure.

4. The climate control system of claim 1, wherein the climate conditions comprise temperature, moisture and humidity.

5. A climate controlled mattress comprising:

an outer contact surface;

a bottom surface opposite the outer contact surface;

a plurality of individual layers disposed between the outer contact surface and the bottom surface;

a heating mechanism disposed between the outer contact surface and the bottom surface and configured to supply heat to at least a portion of the outer contact surface; and a cooling mechanism separate from the heating mechanism and disposed between the outer contact surface the bottom surface, the cooling mechanism configured to pull air into the mattress from the outer contact surface, through the mattress away from the outer contact surface and heating mechanism and toward the bottom surface.

6. The climate controlled mattress of claim 5, wherein:

the plurality of individual layers comprises:

a first layer comprising the outer contact surface and a plurality of vent holes passing completely through the first layer; and a second layer in contact with the first layer opposite the outer contact surface, the second layer comprising an open cell foam; and the heating mechanism is disposed between the first layer and the second layer.

7. The climate controlled mattress of claim 6, wherein:

the plurality of individual layers further comprises:

a third layer in contact with the second layer opposite the first layer; and a fourth layer in contact with the third layer opposite the second layer, the third layer and fourth layer comprising foam layers; and the cooling mechanism comprises:

a channel passing completely through the third layer; and a fan assembly extending through the fourth layer, the fan assembly aligned with the channel.

8. The climate controlled mattress of claim 7, wherein the fan assembly comprises:

a fan box extending through the fourth layer;

a mounting bezel attached to the attached to one end of the fan box;

a fan attached to the mounting bezel; and a fan shroud mounted on the fan.

9. The climate control mattress of claim 6, wherein the plurality of individual layers further comprises a support layer in contact with the second layer opposite the top layer, the support layer comprising an air mesh having a thickness of up to about 0.4 inches.

10. The climate controlled mattress of claim 6, wherein:

the plurality of individual layers further comprises a third layer in contact with the second layer opposite the first layer; and the cooling mechanism comprises:

a channel passing completely through the third layer; and a fan assembly extending partially through the channel.

11. The climate controlled mattress of claim 10, wherein:

the third layer comprises an exhaust conduit in communication with the channel and running along the bottom surface; and the fan assembly comprises:

a mounting bezel in contact with the bottom surface;

a fan box attached to the mounting bezel and extending into the channel, the fan box comprising a port in communication with the exhaust conduit; and a fan attached to the fan box opposite the mounting bezel.

12. The climate controlled mattress of claim 5, further comprising an operational control system in communication with the heating mechanism and cooling mechanism to operate the heating mechanism and the cooling mechanism to achieve desired climate conditions on the outer contact surface of the mattress.

13. The climate controlled mattress of claim 5, wherein:

the outer contact surface comprises:

a head end;

a foot end opposite the head end;

a pair of opposing sides extending from the head end to the foot end; and a plurality of non-overlapping zones running along the outer contact surface, each zone occupying at least a portion of a length between the head end and the foot end and at least a portion of a width between the pair of opposing sides; and the heating mechanism and the cooling mechanism are controllable to achieve desired climate conditions on the outer contact surface separately in each zone.

14. The climate controlled mattress of claim 13, wherein the heating mechanism comprises a single heating element extending through all zones in the plurality of zones, the single heating element comprising a plurality of separately controllable heating regions, at least one heating region disposed in each zone.

15. The climate controlled mattress of claim 13, wherein the heating mechanism includes a plurality of separate heating elements, at least one heating element disposed in each zone.

16. The climate controlled mattress of claim 13, wherein the cooling mechanism comprises:

a single channel passing completely through at least one layer in the plurality of layers, the single channel in communication with each zone in the plurality of zones; and a fan assembly in communication with the single channel to pull air away from the outer contact surface in each zone and toward the bottom surface.

17. The climate controlled mattress of claim 13, wherein the cooling mechanism comprises:

a plurality of separate channels passing completely through at least one layer in the plurality of layers, at least one channel disposed within each zone in the plurality of zones; and a plurality of fan assemblies, each fan assembly in communication with one of the channels to pull air away from the outer contact surface in one of the plurality of zones and toward the bottom surface.

18. The climate controlled mattress of claim 13, wherein a size and a location on the outer contact surface of each zone in the plurality of zones corresponds to anthropometric measurements for at least 50% of humans.

19. The climate controlled mattress of claim 13, further comprising an operational control system in communication with the heating mechanism and the cooling mechanism to operate the heating mechanism and the cooling mechanism to achieve desired climate conditions in each one of the plurality of zones of the outer contact surface.

20. A climate controlled mattress comprising:

an outer contact surface;

a bottom surface opposite the contact surface;

a plurality of individual layers disposed between the contact surface and the bottom surface, the plurality of individual layers comprising:

a first layer comprising the outer contact surface and a plurality of vent holes passing completely through the first layer;

a second layer in contact with the first layer opposite the outer contact surface, the second layer comprising an open cell foam;

a third layer in contact with the second layer opposite the first layer; and a fourth layer in contact with the third layer opposite the second layer, the third layer and fourth layer comprising foam layers;

a heating mechanism disposed between the first layer and the second layer and configured to supply heat to at least a portion of the outer contact surface; and a cooling mechanism separate from the heating mechanism and disposed between the outer contact surface the bottom surface, the cooling mechanism configured to pull air through the mattress away from the outer contact surface and heating mechanism and toward the bottom surface, the cooling mechanism comprising:

a channel passing completely through the third layer; and a fan assembly extending through the fourth layer, the fan assembly aligned with the channel.

* * * * *